US006078243A

United States Patent [19]

Barnes et al.

[11] Patent Number: 6,078,243

[45] **Date of Patent: *Jun. 20, 2000**

[54] ADAPTIVE APPLIANCE CONTROL MODULE INCLUDING SWITCHING RELAY

[76] Inventors: Gregory Barnes, 4827 CrowFoot Rd., Murrayville, Pa. 15668; Jon Skekloff, 2957 132nd Ave., Holland, Mich. 49424; David D. Martin, RD #2 Maple St., Dunbar, Pa. 16431; Douglas Ray, 13 N. Hempfield Ave., Irwin, Pa. 15642

[ * ] Notice: This patent is subject to a terminal disclaimer.

[21] Appl. No.: 09/094,582

[22] Filed: Jun. 12, 1998

Related U.S. Application Data

[60] Provisional application No. 60/049,445, Jun. 12, 1997.

[51] Int. Cl.[7] ..... H01H 61/00

[52] U.S. Cl. ..... 337/140; 337/395; 62/151; 62/229

[58] Field of Search ..... 62/151, 229, 180; 337/140, 382, 393, 395; 60/527, 528

[56] References Cited

U.S. PATENT DOCUMENTS

| | | | |
|---|---|---|---|
| 3,634,803 | 1/1972 | Willson et al. | 337/123 |
| 3,725,835 | 4/1973 | Hopkins et al. | 337/140 |
| 3,968,380 | 7/1976 | Jost et al. | 307/99 |
| 4,007,404 | 2/1977 | Jost et al. | 317/123 |
| 4,251,988 | 2/1981 | Allard et al. | 62/80 |
| 4,395,887 | 8/1983 | Sweetman | 62/155 |
| 4,544,988 | 10/1985 | Hochstein | 361/211 |
| 4,551,975 | 11/1985 | Yamamoto et al. | 60/528 |
| 4,700,541 | 10/1987 | Gabriel et al. | 60/528 |
| 4,850,204 | 7/1989 | Bos et al. | 62/234 |
| 4,887,430 | 12/1989 | Kroll et al. | 60/527 |
| 4,940,079 | 7/1990 | Best et al. | 165/2 |
| 5,083,439 | 1/1992 | Orner et al. | 62/187 |
| 5,129,753 | 7/1992 | Wesley et al. | 403/322 |
| 5,295,361 | 3/1994 | Novak et al. | 62/128 |
| 5,306,979 | 4/1994 | Schwarz, Jr. | 310/328 |
| 5,410,290 | 4/1995 | Cho | 337/140 |
| 5,479,785 | 1/1996 | Novak | 62/155 |
| 5,533,349 | 7/1996 | Gromala et al. | 62/214 X |
| 5,533,350 | 7/1996 | Gromala et al. | 62/155 |
| 5,684,448 | 11/1997 | Jacobsen et al. | 337/140 |

FOREIGN PATENT DOCUMENTS

| | | |
|---|---|---|
| 0145204 | 6/1985 | European Pat. Off. . |
| 3731146 | 3/1989 | Germany . |
| 3731146A1 | 3/1989 | Germany . |
| 01183027 | 7/1989 | Japan . |
| 2143015 | 1/1985 | United Kingdom . |

*Primary Examiner*—Harry B. Tanner
*Attorney, Agent, or Firm*—Terrance Martin; Sean Detweiler; Jules Jay Morris

[57] ABSTRACT

A novel shape memory alloy electrical switch is disclosed, including both momentary and especially a latching relay. The switch/relay disclosed is particularly useful in low power control of appliances, including i.a. refrigerators. Used with a microprocessor, microcontroller, or like device to control the shape memory alloy switch/relay, an adaptive control routine may be included which facilitates an especially low-power dissipation, highly effective appliance control module, especially suitable for refrigerators. The disclosed refrigerator control module can be manufactured at low cost with high reliability.

35 Claims, 26 Drawing Sheets

ADAPTIVE APPLIANCE CONTROL MODULE INCLUDING SWITCHING RELAY

RELATED APPLICATIONS

This application is based on subject matter disclosed in provisional application 60/049,445 filed Jun. 12, 1997, and claims the benefit of that filing date.

TECHNICAL FIELD

The present invention discloses an appliance control which incorporates a novel shape memory alloy electrical switch, and more particularly, a shape memory alloy relay, including both momentary and especially a latching relay. The relay disclosed is particularly useful in low power control of appliances, including refrigerators, and when used with a microprocessor, microcontroller, or like device to control the shape memory alloy relay, inclusion of an adaptive control routine facilitates an especially low-power dissipation, highly effective appliance control module, especially for refrigerators, at low cost and high reliability.

BACKGROUND OF THE INVENTION

Relays are used to control household and other appliances, and especially for control of higher power consumption appliances such as refrigerators which include electrical compressors and defrosting elements that must be switched on and off regularly to function properly. Such relays have heretofore required substantial current drain to ensure reliable contact closure and to maintain such contact closure through the operation cycle of the appliance elements, such as the compressor and defroster in a modern refrigerator. Conventional latching relays are not preferred due to high cost, high operating currents, and other limitations.

Adaptive control of appliances, including refrigerators, is known. However, when coupled with the drivers required to operate conventional relays, whether of the latching type or otherwise, such advanced appliance controllers have been difficult to manufacture at the highly competitive low costs required in the consumer appliance market. Such controls have largely been limited to higher-end, commercial appliances and top line consumer appliances.

Examples of adaptive control of appliances, especially refrigerators include U.S. Pat. Nos. 4,251,988, 4,395,887, 4,850,204, 5,295,361, 5,479,785, all assigned to Paragon Electric Company, Inc., (a subsidiary of Siebe plc, parent of Robertshaw Controls Company, owner of the present disclosure), 5,533,349 and 5,533,350, both assigned to Robertshaw Controls Company, and others.

DISCLOSURE OF THE INVENTION

The shape memory alloy (SMA) switch and relay disclosed herein can be substituted for many electrically activated switches. Application of electrical current to a shape memory alloy switch actuator causes the length of the SMA actuator to vary; this movement is used to open or close switch contacts. The SMA switch actuator can be configured as a coil spring element or more preferably, an elongated wire. An SMA switch capable of latching in one or more stable states provides useful relay functions.

An SMA switch/relay has many uses. It may be substituted for a conventional relay in many uses, with the number of relay contact sets provided depending largely on the available space, the current drain of the SMA actuator, and the required contact size. A latching relay according to the present invention is formed from an elongated SMA wire having fixed opposing first and second end points and a point of contact along the length thereof.

A cantilevered or other snap-action arm (a bistable snap blade) is disposed along the length of the SMA wire near the point of contact, and preferably oriented generally normal to the axis of the SMA wire. The snap-action arm is joined to the point of contact such that when the point of contact shifts in a first direction along its length relative to the snap-action arm, the arm snaps to a (preferably but not necessarily) fixed position in that direction. And when the point of contact shifts in the opposite direction along its length relative to the first fixed point, the snap-action arm snaps to a (preferably but not necessarily) fixed position in the reverse direction. Thus, shifting the point of contact in a first direction snaps the snap-action arm to a first position and shifting the point of contact in the opposite direction snaps the snap-action arm to a second position in the opposite direction. The end position following a snap action in either direction represents the latched position.

Through suitable selection of SMA materials and selected application of electrical power, the SMA actuator can be operated to move the point of contact in either direction; a substantial force can be generated with only narrow pulses of moderate power applied to the SMA actuator. This motion can be used to operate one or more electrical contacts between an open-circuit condition and a closed-circuit condition, thus powering a latching switch or relay capable of reliably carrying heavy current loads at low operating power.

Electrical contact(s) on the snap-action arm enable connection and disconnection, with a latching switching action, between the snap-action arm and one or more fixed position electrical contacts disposed at the first and/or second position(s). In the event that the switch thus formed is desired to function as a single pole, single throw (ON-OFF) switching contact pair, an end-of-travel post or other stopping element may be provided to limit travel in the OFF position. Similarly, an end-of-travel stop can be provided in the direction of contact closure (i.e., ON) after contact is made in order to permit a limited relative wiping action of the contacts upon closure.

The SMA actuator is activated by passing an electrical current through the SMA actuator between a first end point thereof and the point of contact, which may lie at or near the middle of the SMA element length. The length of the SMA wire between these two points declines with the passage of electrical current therethrough. The snap-action arm then snaps to the position dictated by the point of contact travel. An alternate action or state-changing mechanism, enabling switching back and forth between two positions results. Passing an electrical current pulse through the SMA actuator between a second end point thereof and the point of contact causes the SMA actuator length between these two points to decline and the snap-action arm then snaps to the position thus dictated by the resulting point of contact reverse travel. While the current required to snap the snap-action arm from a first position to a second position depends largely on the snap action spring force to be overcome and the performance characteristics of the SMA actuator element, applicants have determined that useful switching actuation can be accomplished by application of relatively low power for relatively brief periods. The SMA wire resistance is about 1.2 ohms/inch. Each 0.006-inch diameter shape memory alloy wire of about 1 inch nominal working length (exclusive of end attachment means) wire requires approximately 0.72 volts at about 600 milliamps for a period of about one-half second to provide a point of contact travel of about 0.040 inches, enough to latch the snap-action arm into the desired position. Thus, a latching relay according to the present invention includes an elongated actuator having fixed opposing first and second end points and a point of contact along the length thereof; a cantilevered snap-action arm, joined to the point of contact along the wire; a first electrical contact being connected to the snap-action arm at the point of contact; a second electrical contact disposed to snap between a first position and a second position to electrically connect the first and second contacts in a first position and to be electrically isolated therefrom in a second position; a power source for applying a sufficient electrical current between the first end point and the point of contact to close the first and second contacts in the first position; and a power source for applying a sufficient electrical current between the second end point and the point of contact to separate the first and seconds contacts in the second position.

The SMA switch/relay, and especially a latching SMA relay according to another embodiment of the present invention can be usefully incorporated into an appliance control module device which includes a housing defining a space; a shape memory alloy relay (either momentary, or preferably, latching) disposed in the housing; and control circuitry for actuating the shape memory alloy relay, such that the control circuit includes a programmable microprocessor or programmable microcontroller, or the like.

A refrigerator control module according to another embodiment of the present invention includes an electrical power source; an enclosure defining a space to be refrigerated; a housing; a shape memory alloy switch/relay (especially of the latching type) disposed in the housing; a temperature sensor; and a control circuit, responsive to the temperature sensor, for actuating the SMA relay to selectively couple the electrical power source to at least one of a compressor and a defrosting element.

An adaptive appliance control module according to another embodiment of the present invention utilizes the microprocessor, microcontroller, or equivalent circuit to operate the appliance according to an adaptive appliance control routine, which may be stored in the microprocessor device or separately, as desired. Such an adaptive appliance control module includes a housing defining a space; a shape memory alloy latching switch/relay disposed in the housing; and a programmable microprocessor or microcontroller, associated with an adaptive appliance control routine, for i) actuating the shape memory alloy latching relay, and ii) adaptive control of an appliance responsive to the programmable microprocessor.

An adaptive refrigerator control module according to another embodiment of the present invention utilizes the microprocessor, microcontroller or equivalent circuit to operate the refrigerator according to an adaptive refrigerator control routine, which may be stored in the microprocessor device or separately, as desired. Such an adaptive refrigerator control module includes an electrical power source; an enclosure defining a space to be refrigerated; a housing, a shape memory alloy latching switch/relay disposed in the housing; at least one temperature sensor; and a programmable microprocessor or microcontroller circuit, associated with an adaptive refrigerator control routine, for i) actuating the shape memory alloy latching switch/relay responsive to the temperature sensor(s) to couple the electrical power source to at least one of a compressor and a defrosting element, and ii) adaptive control of refrigeration of the enclosure space.

BRIEF DESCRIPTION OF THE DRAWING FIGURES

The features and advantages of the present invention will be more clearly appreciated from the following description of the preferred embodiments of the invention taken in conjunction with the accompanying drawing figures, in which like reference numerals indicate like elements, and wherein.

Figure 3:
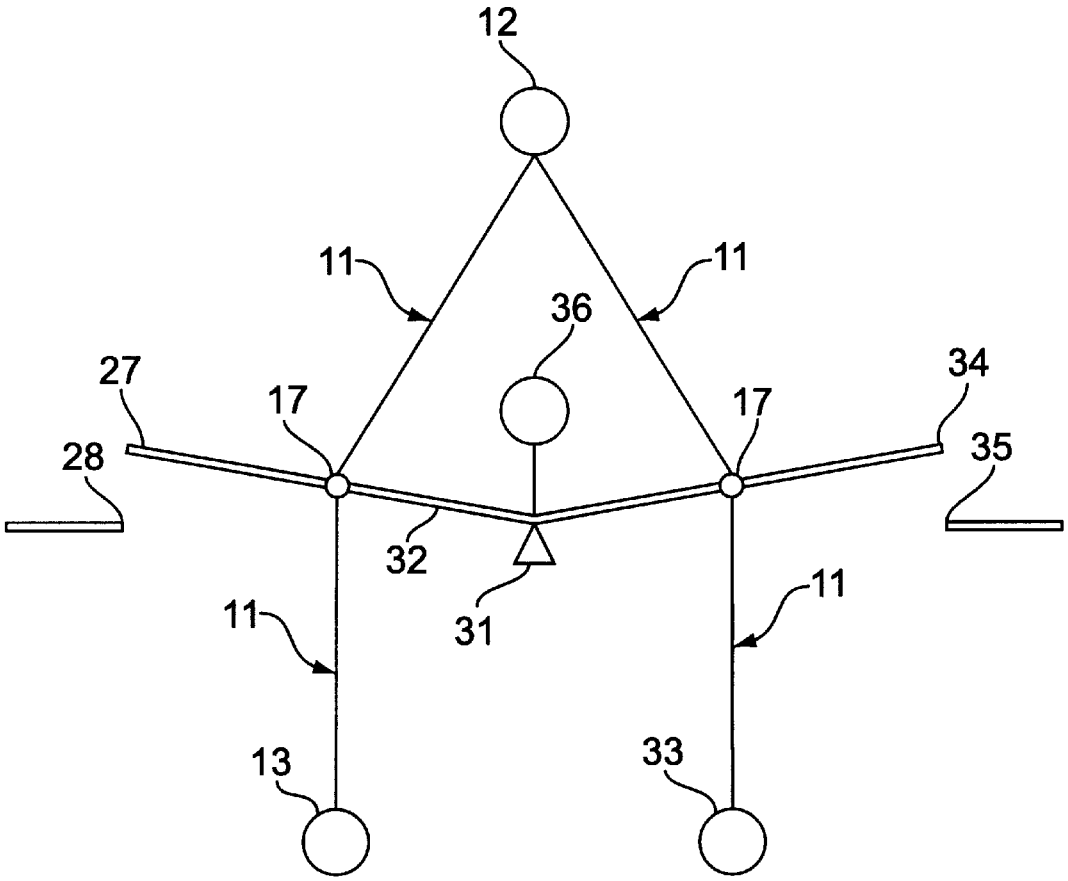
FIG. 3 illustrates a simplified view of a dual shape memory alloy switch of FIG. 1, operated as a double-pole latching relay.
Figure 6A:
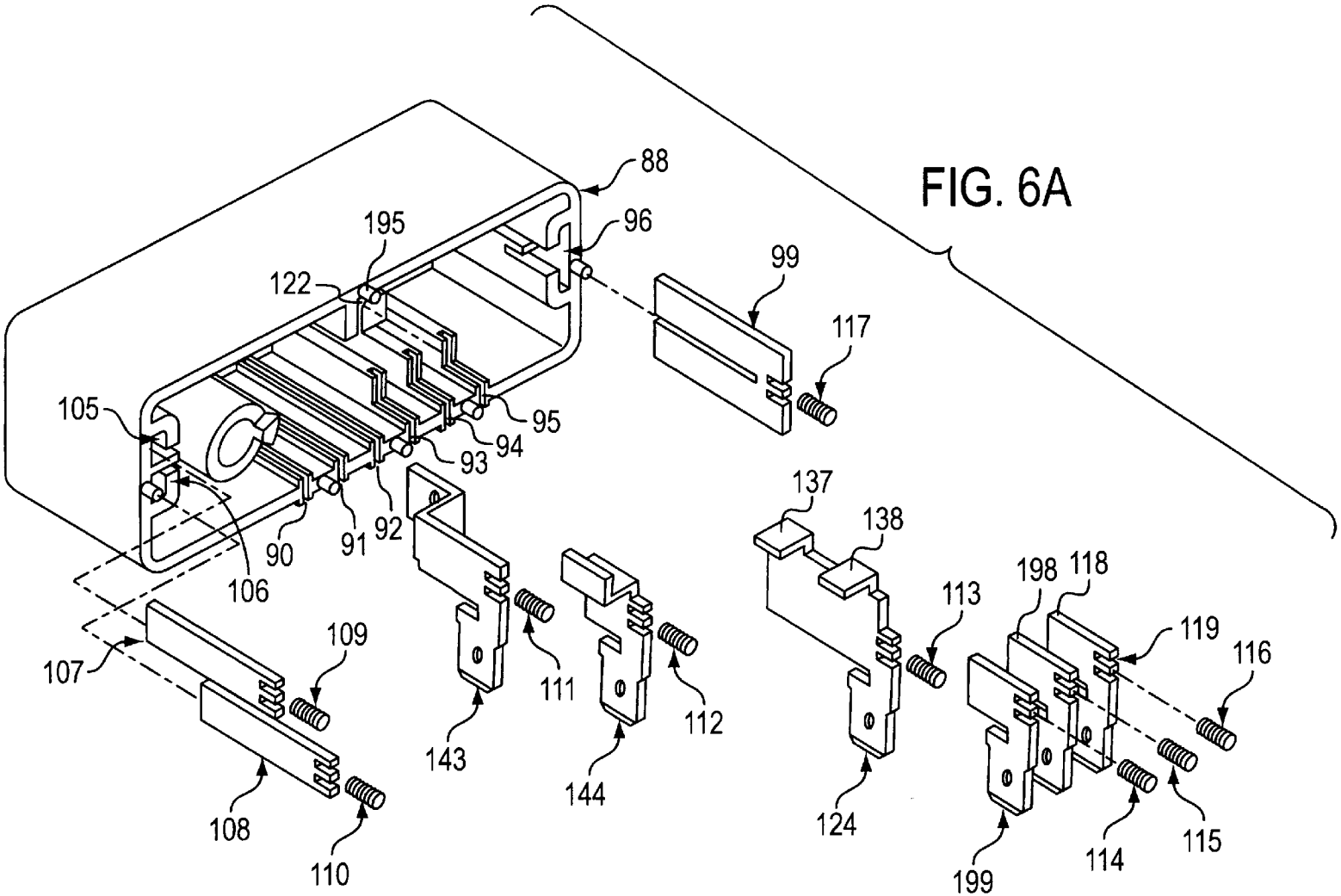
Figures 6B, 6C:
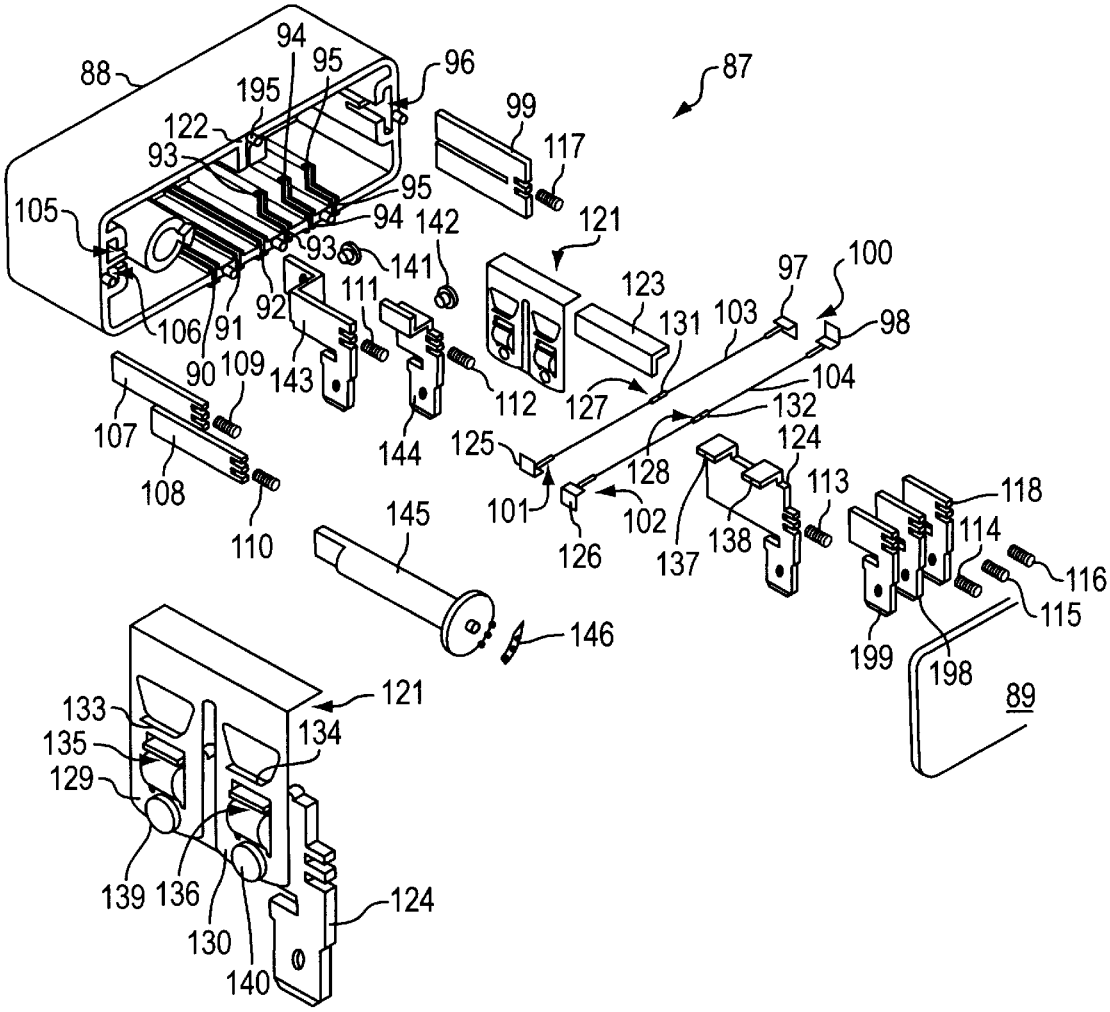
Figure 7:
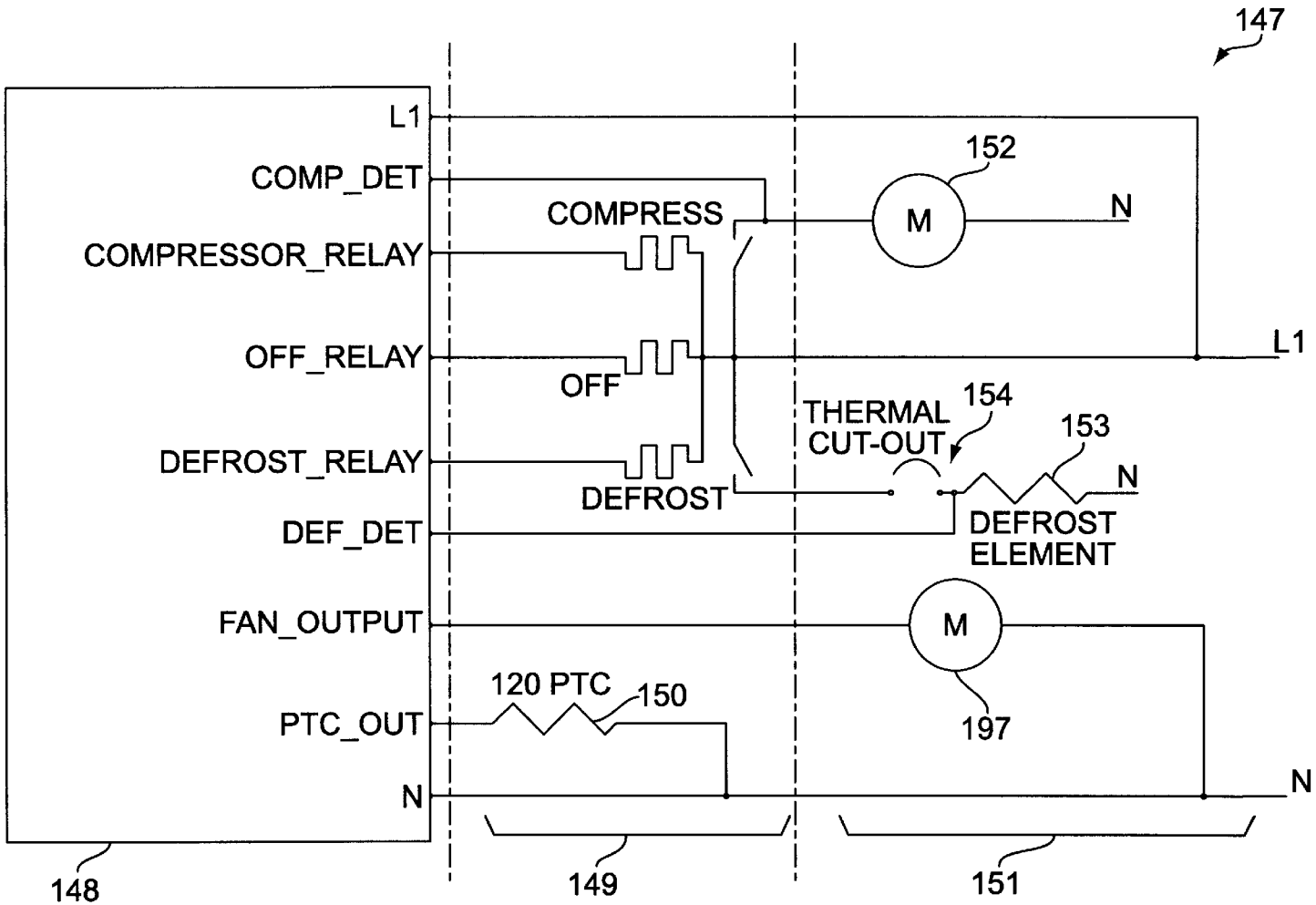
Figure 8:
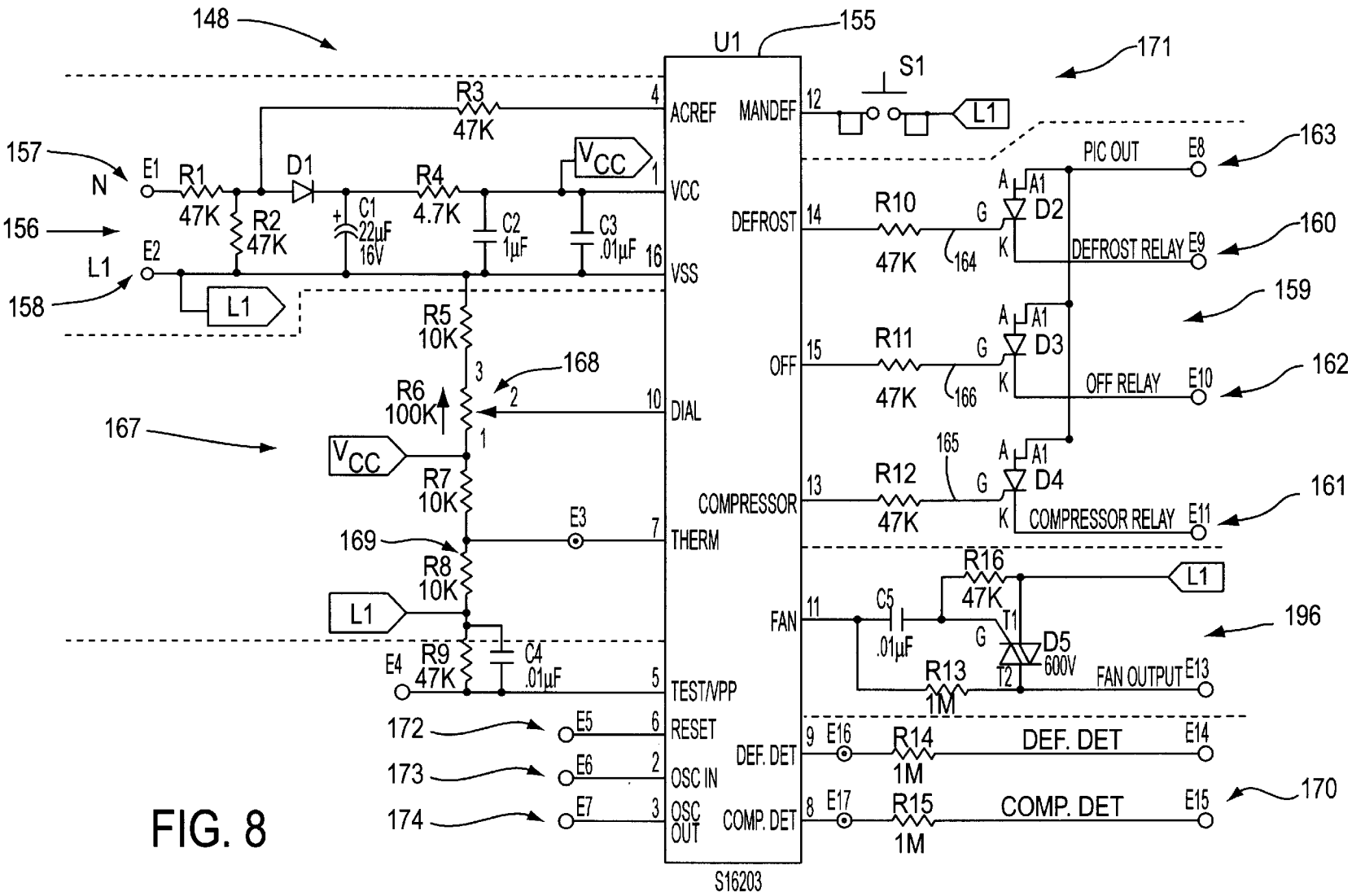
Figure 9:
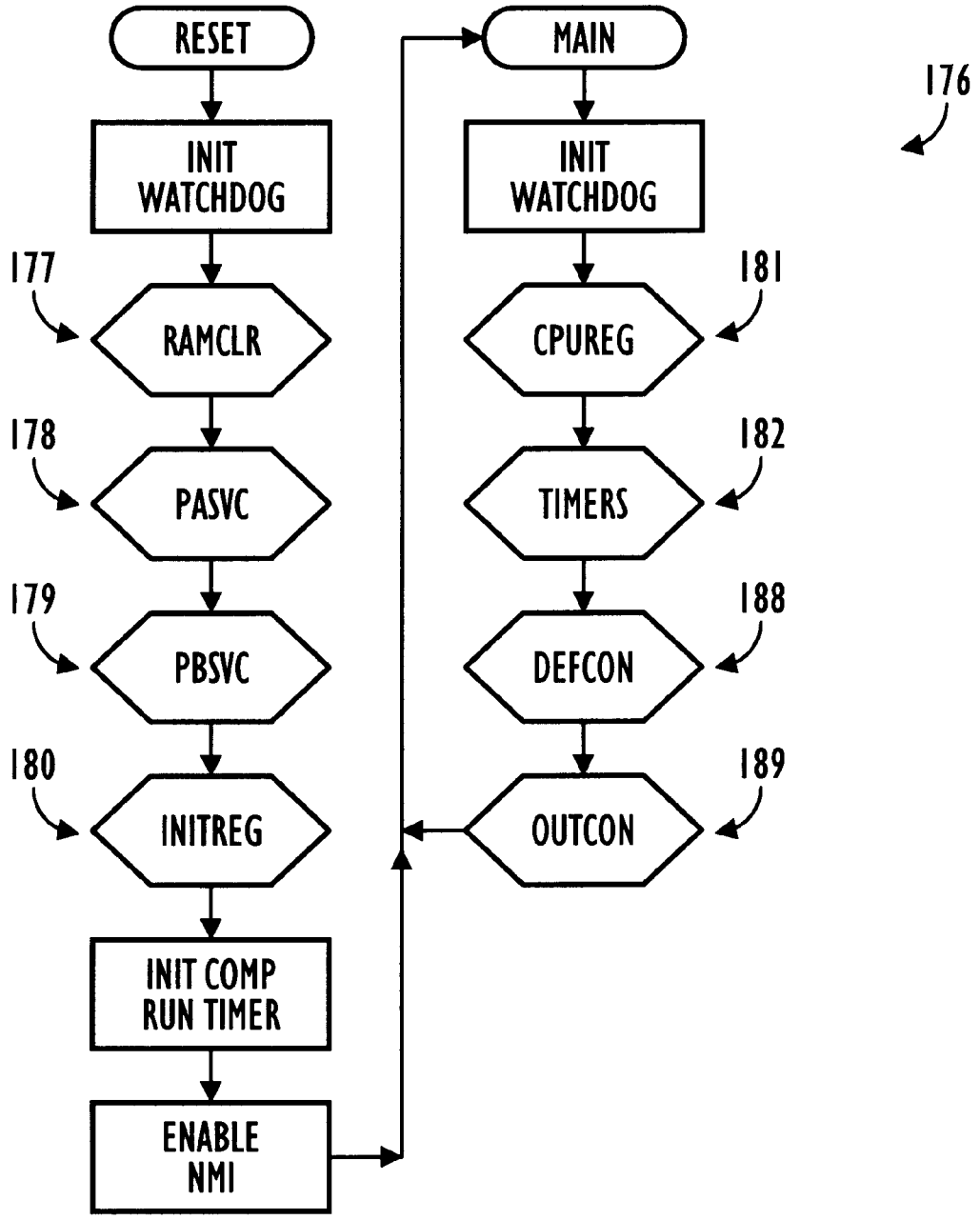
Figure 10:
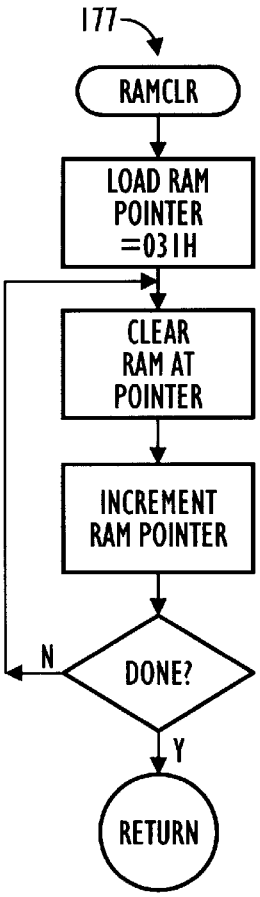
Figure 11:
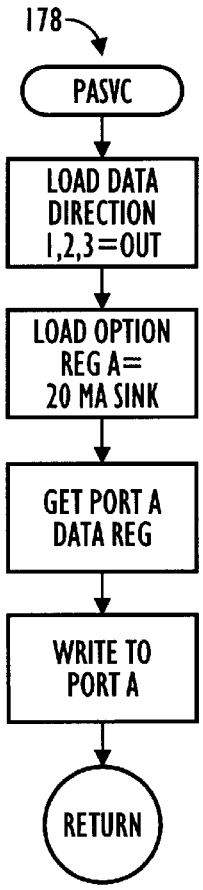
Figure 12:
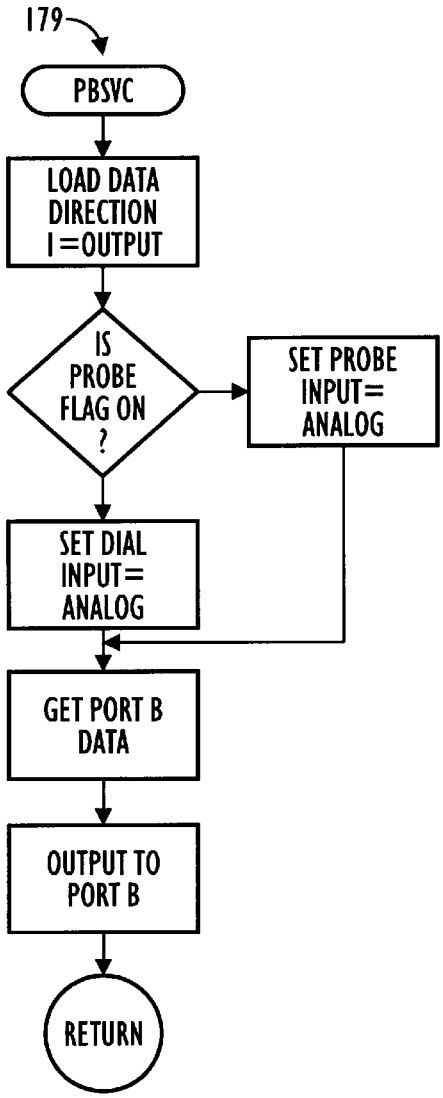
Figure 13:
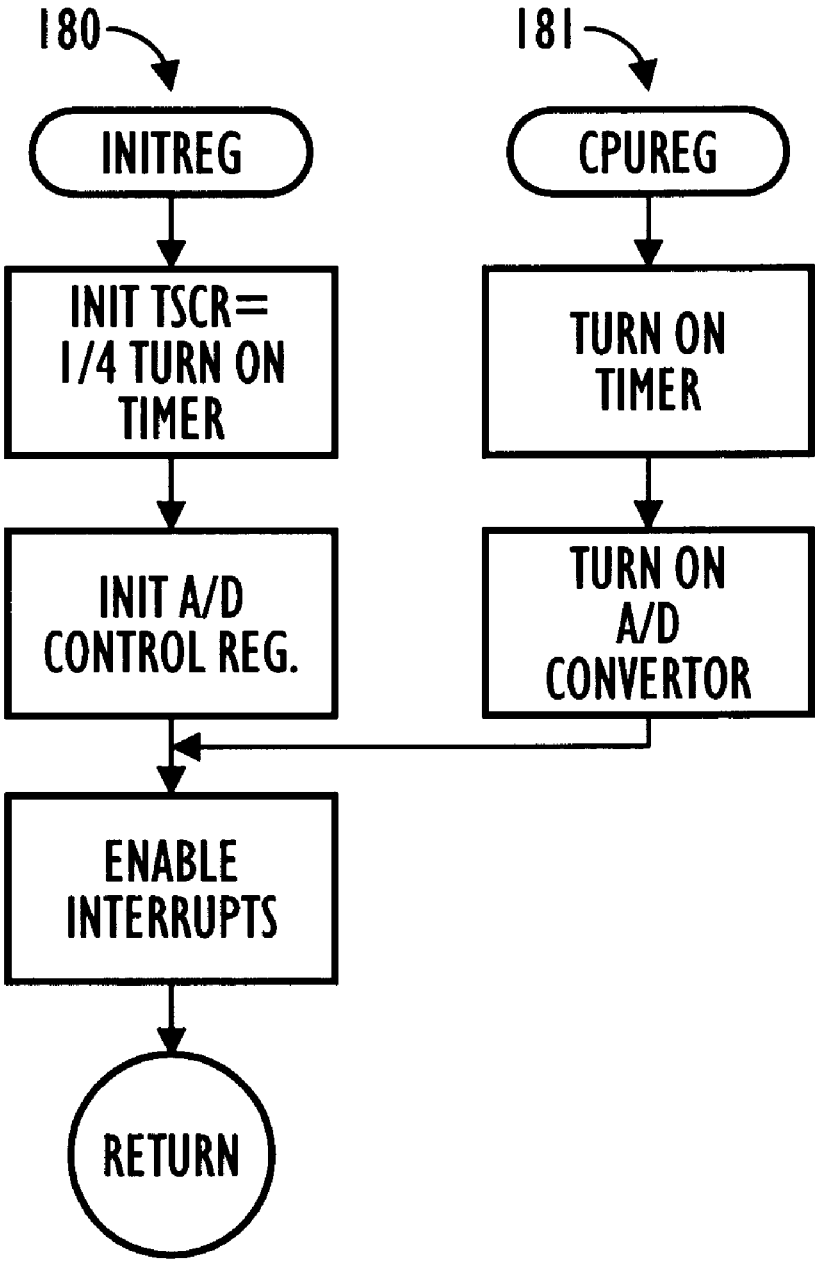
Figure 14:
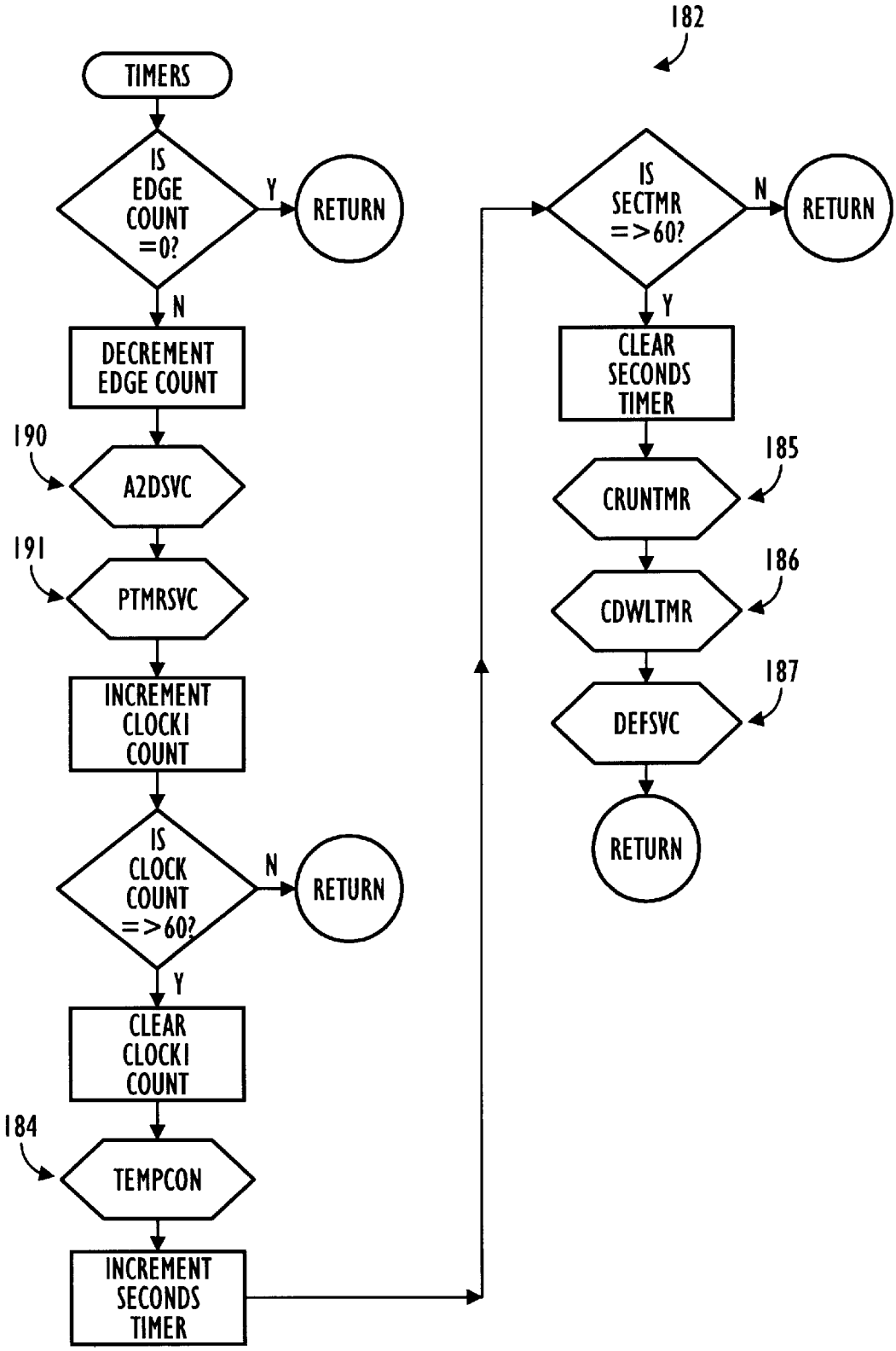
Figure 15:
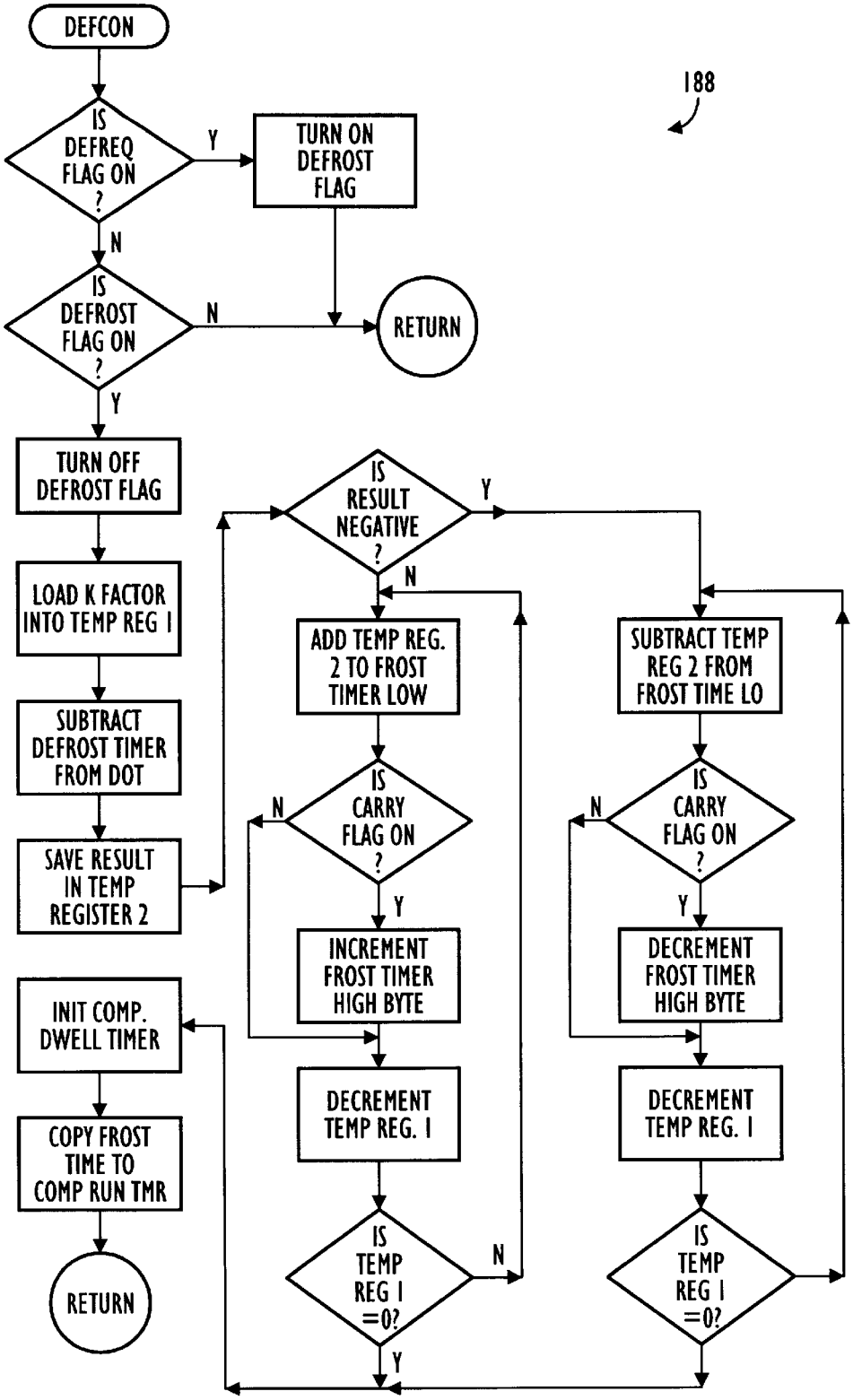
Figure 16:
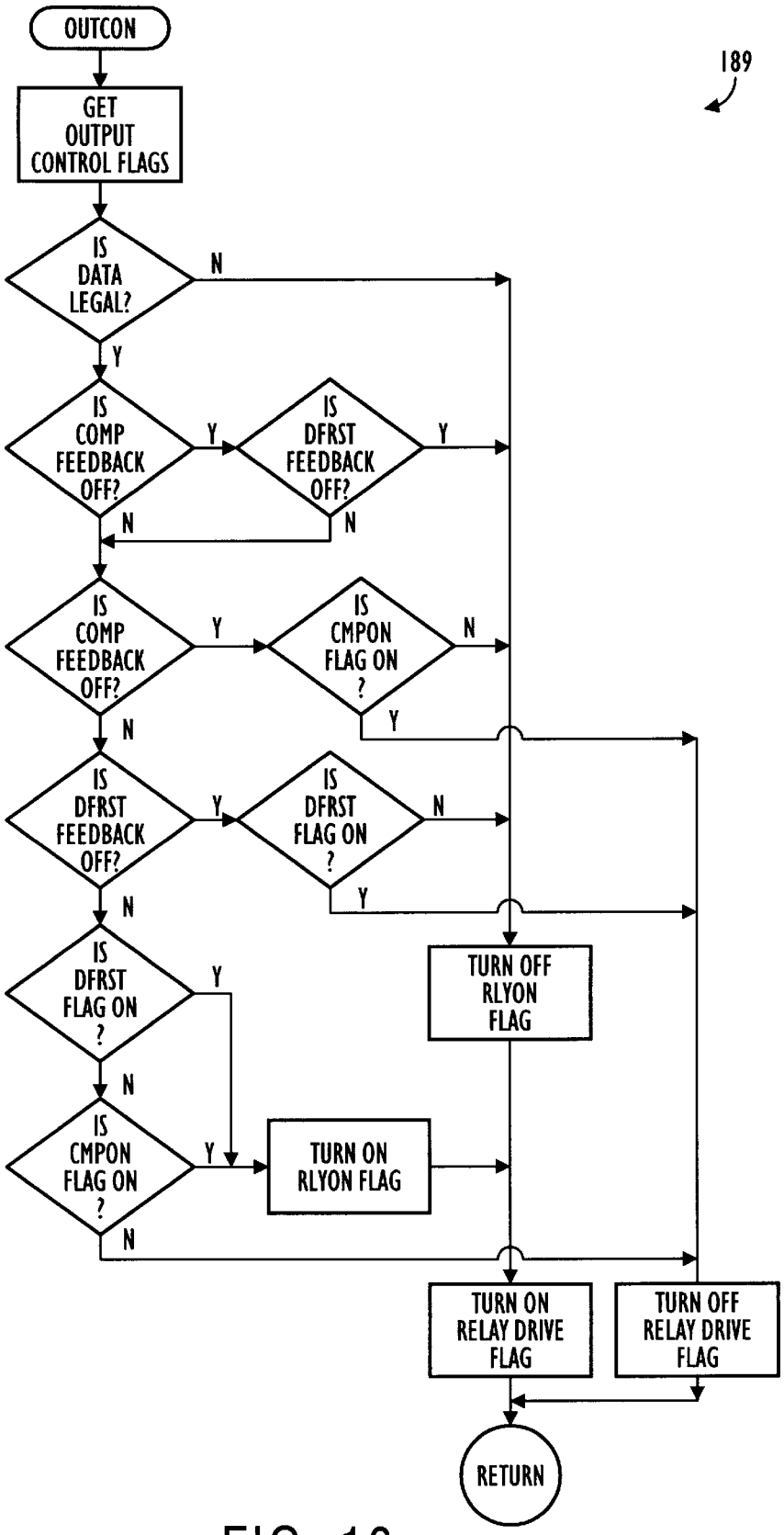
Figure 17:
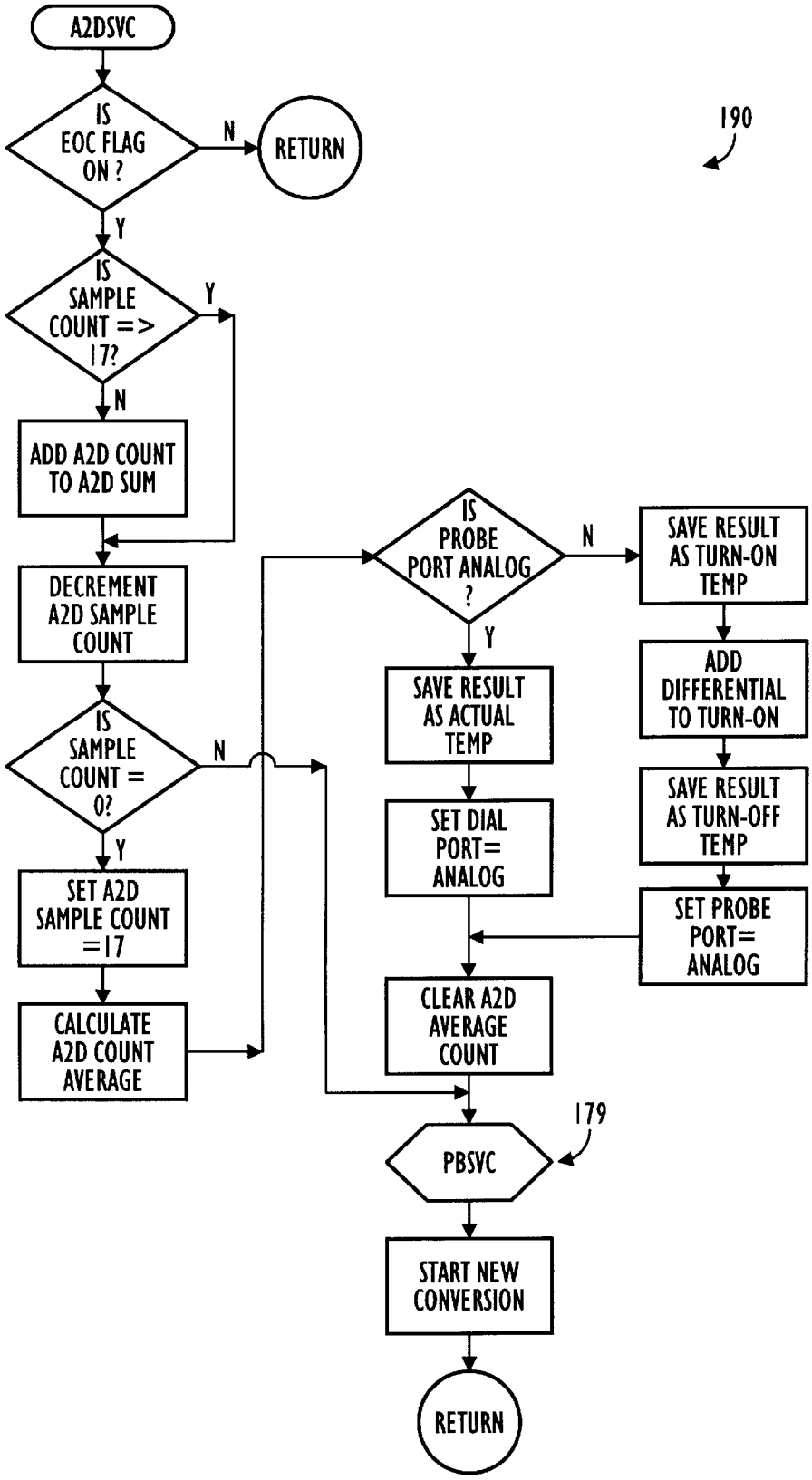
Figure 22:
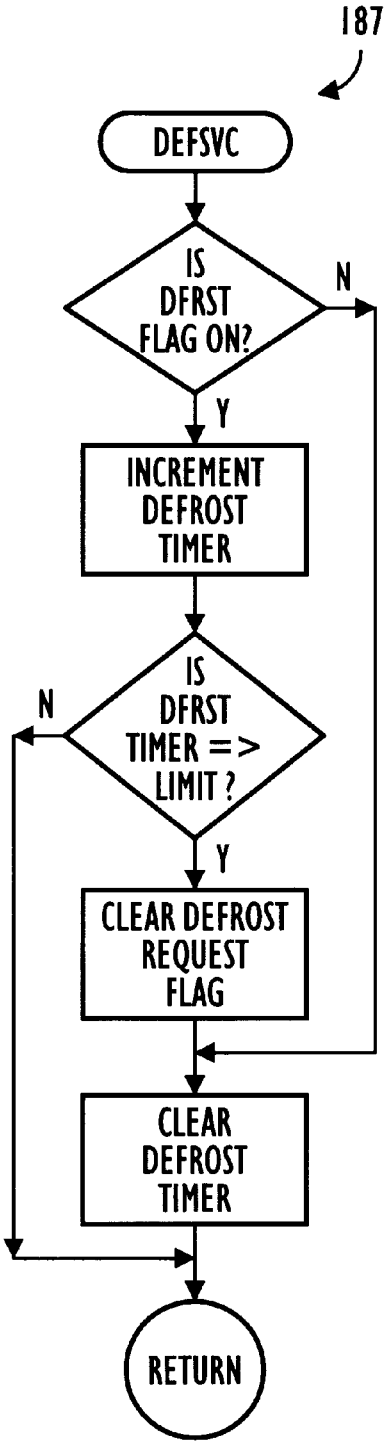
Figure 18:
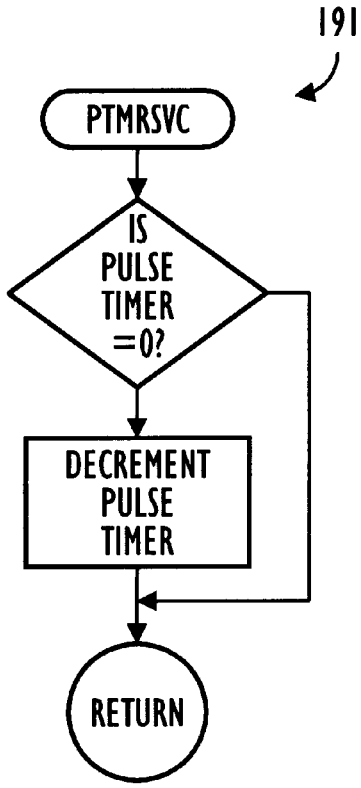
Figure 19:
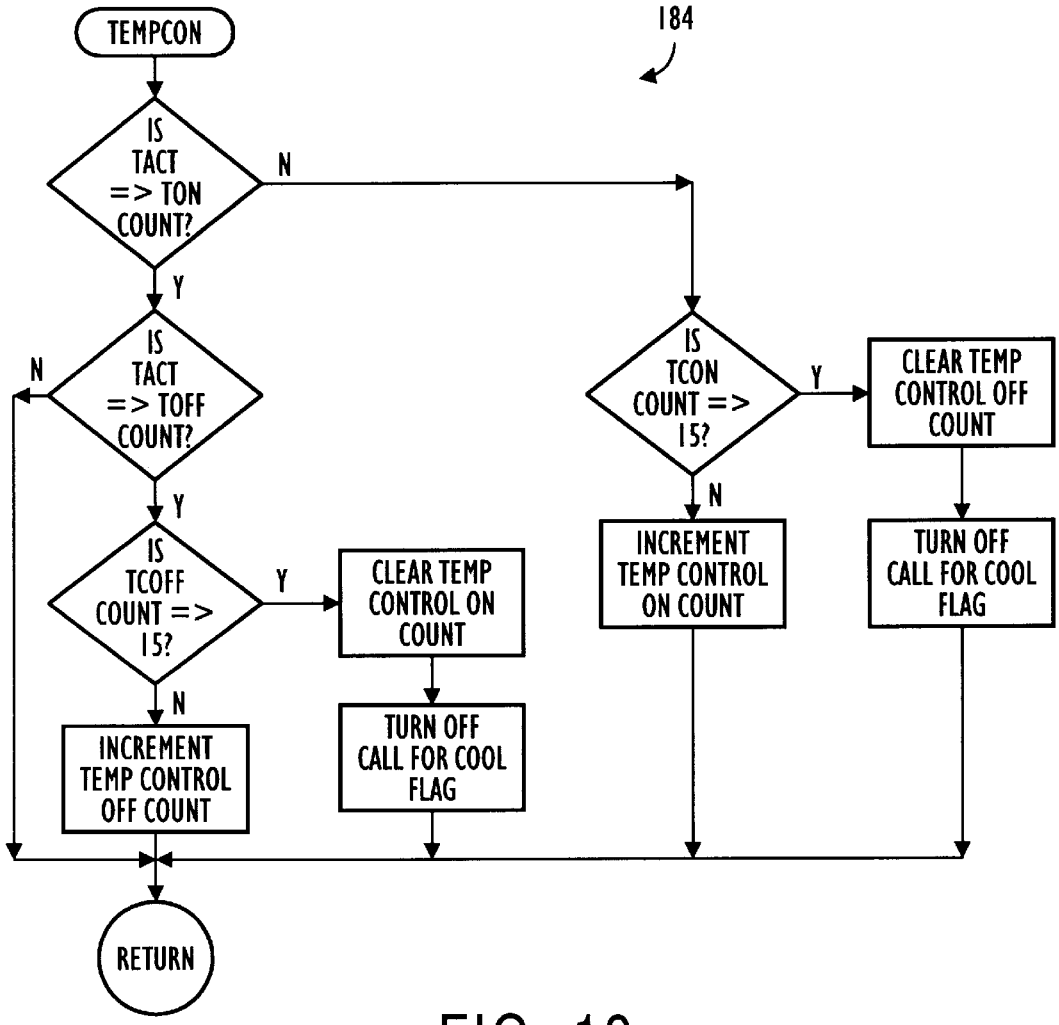
Figure 20:
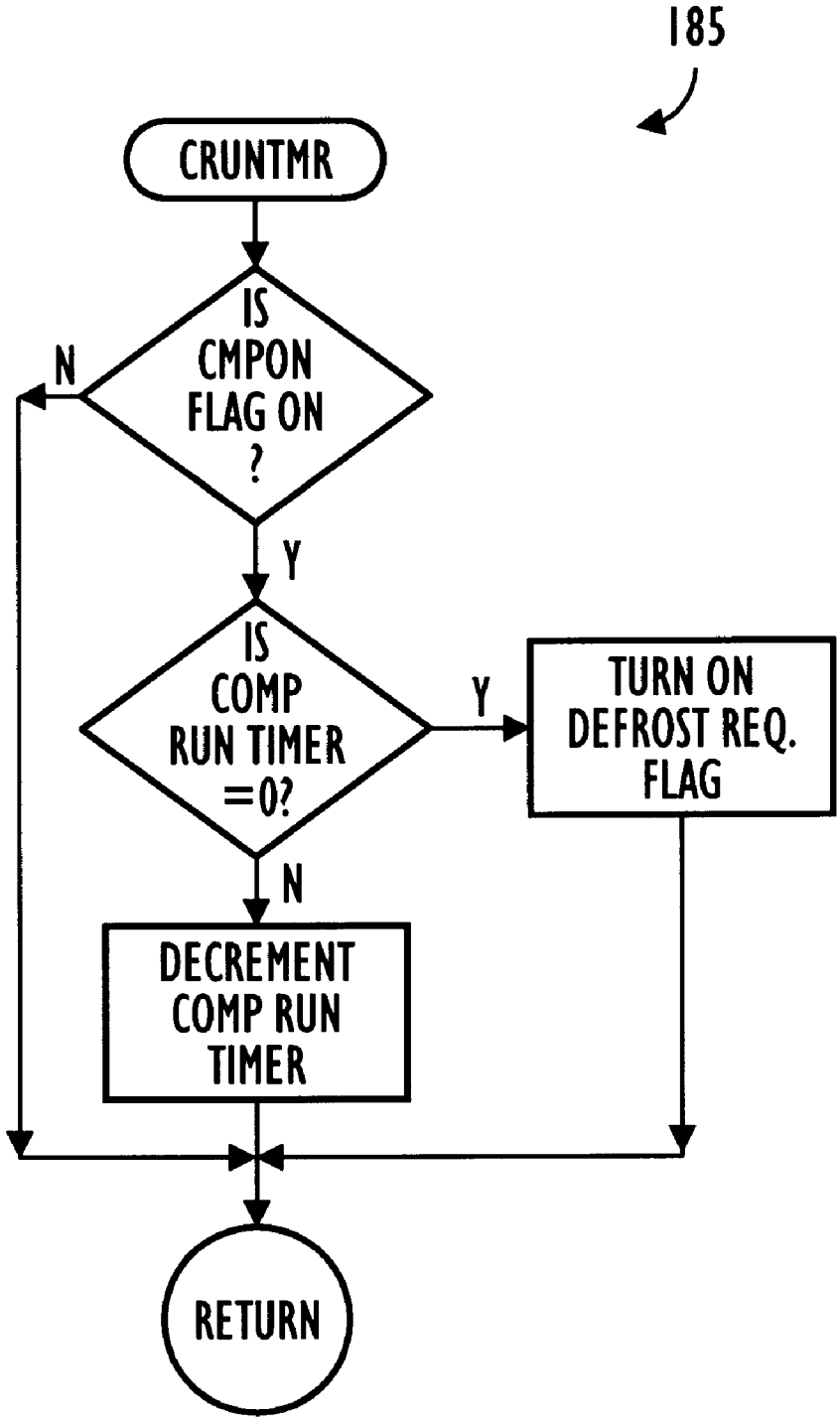
Figure 21:
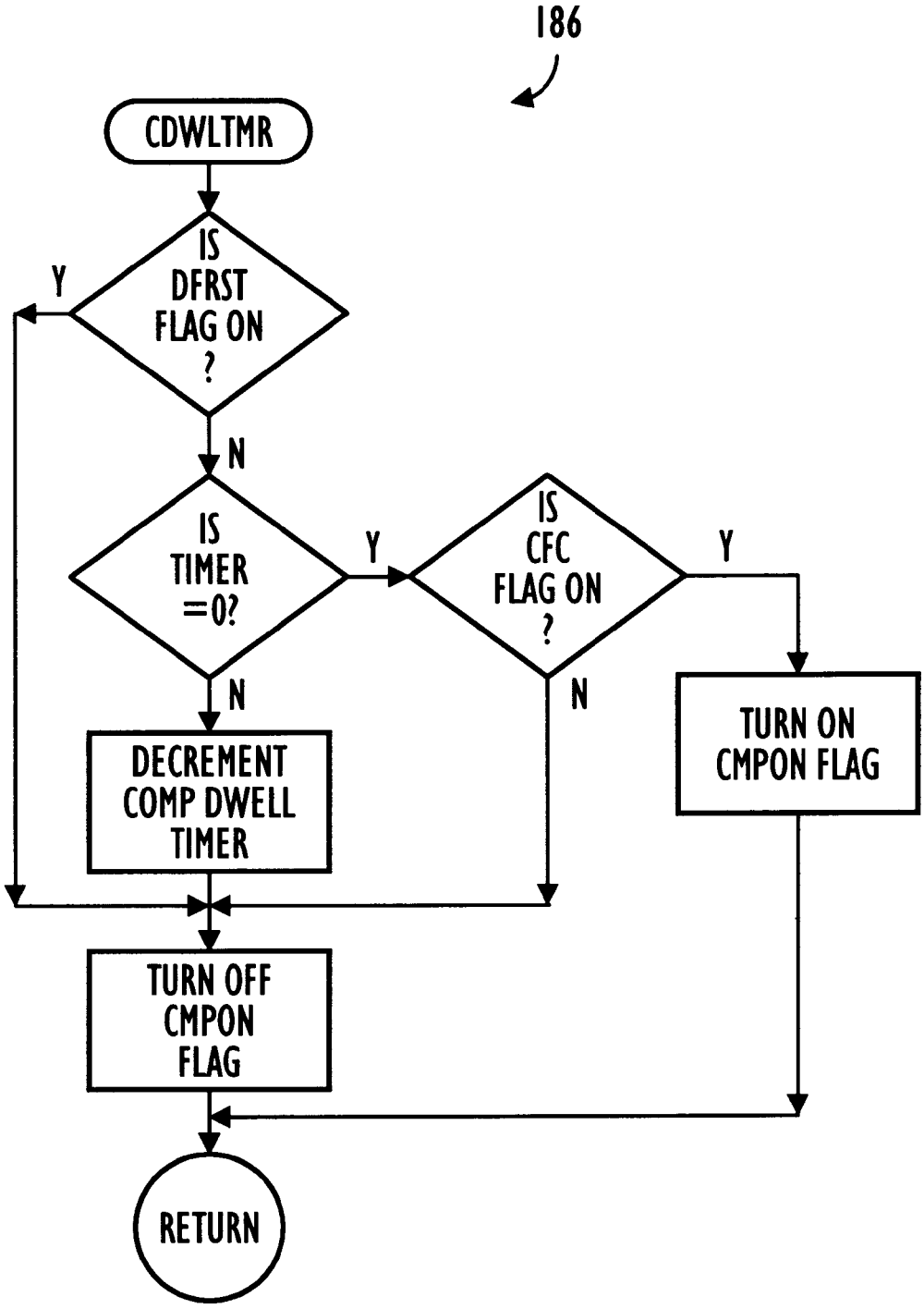
Figure 23:
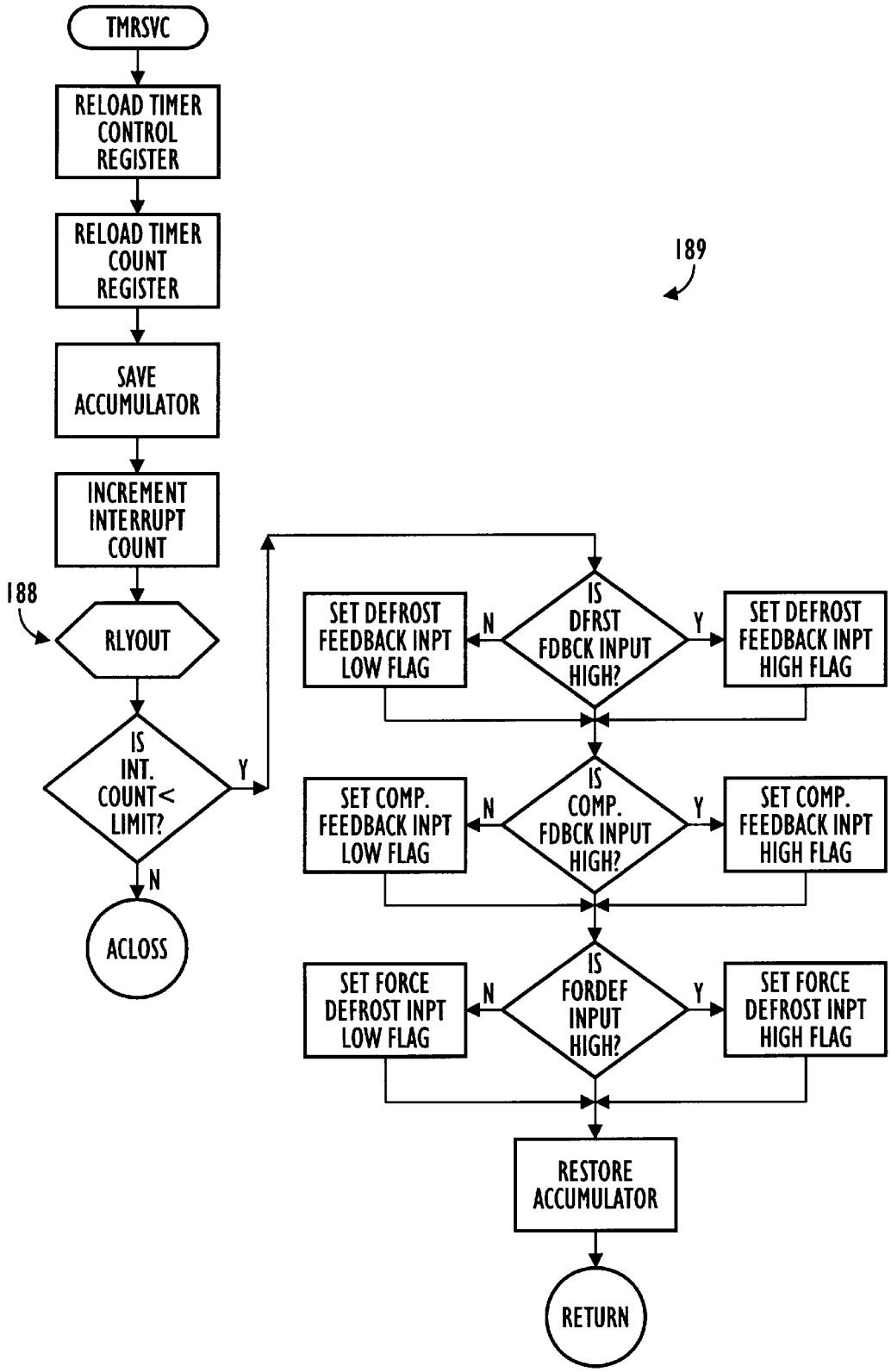
Figure 24:
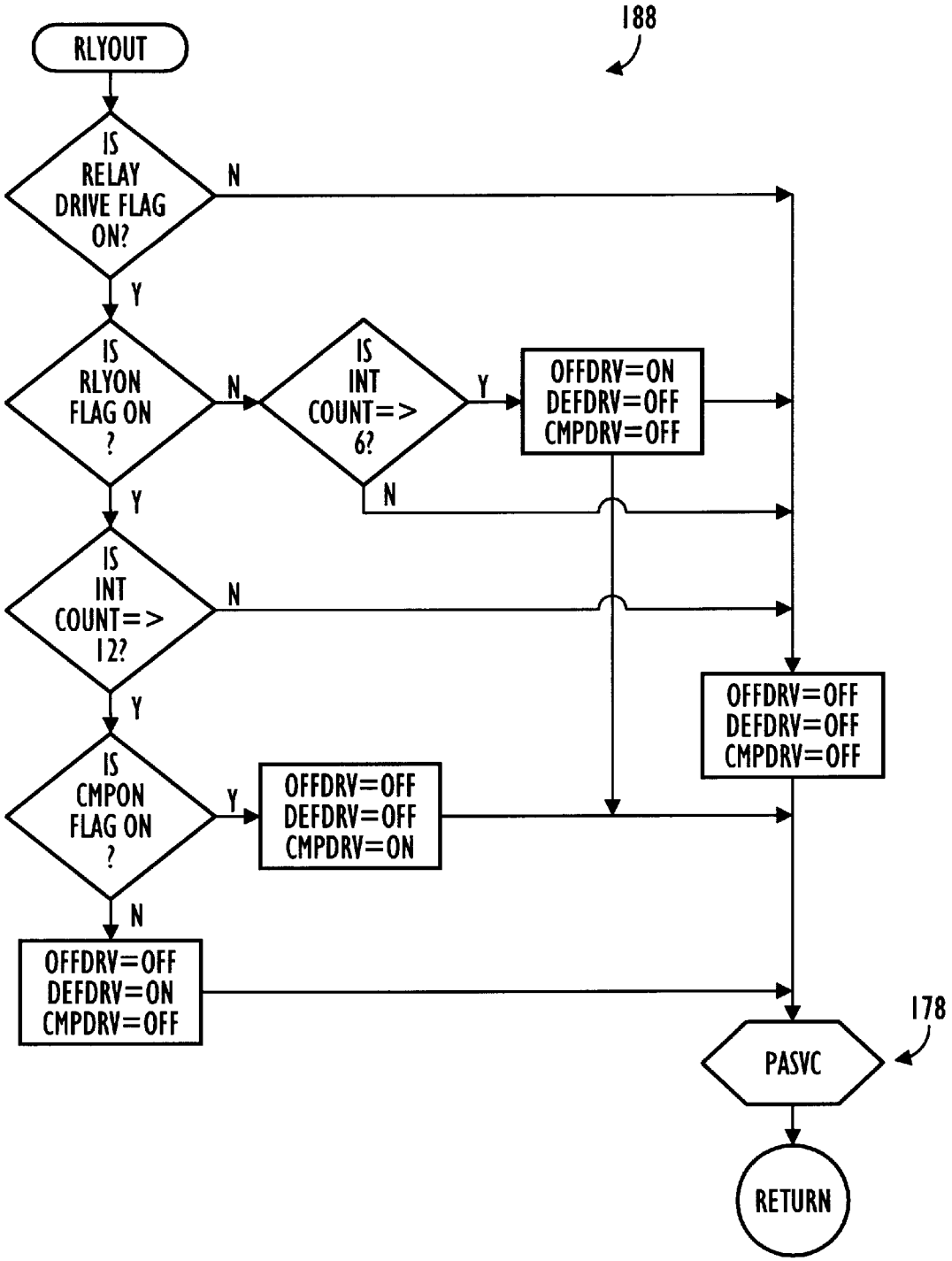
Figure 25:
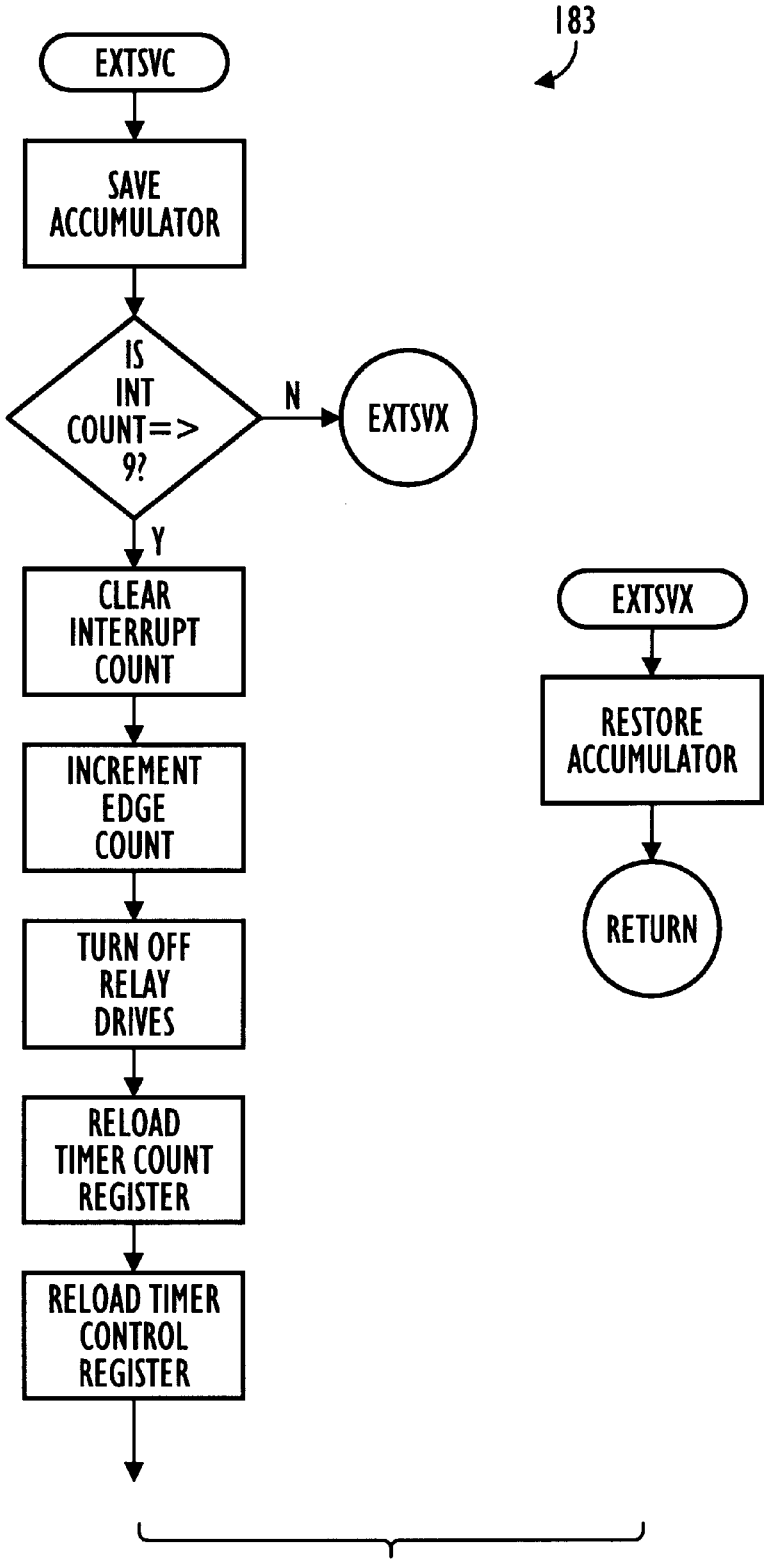
Figure 26:
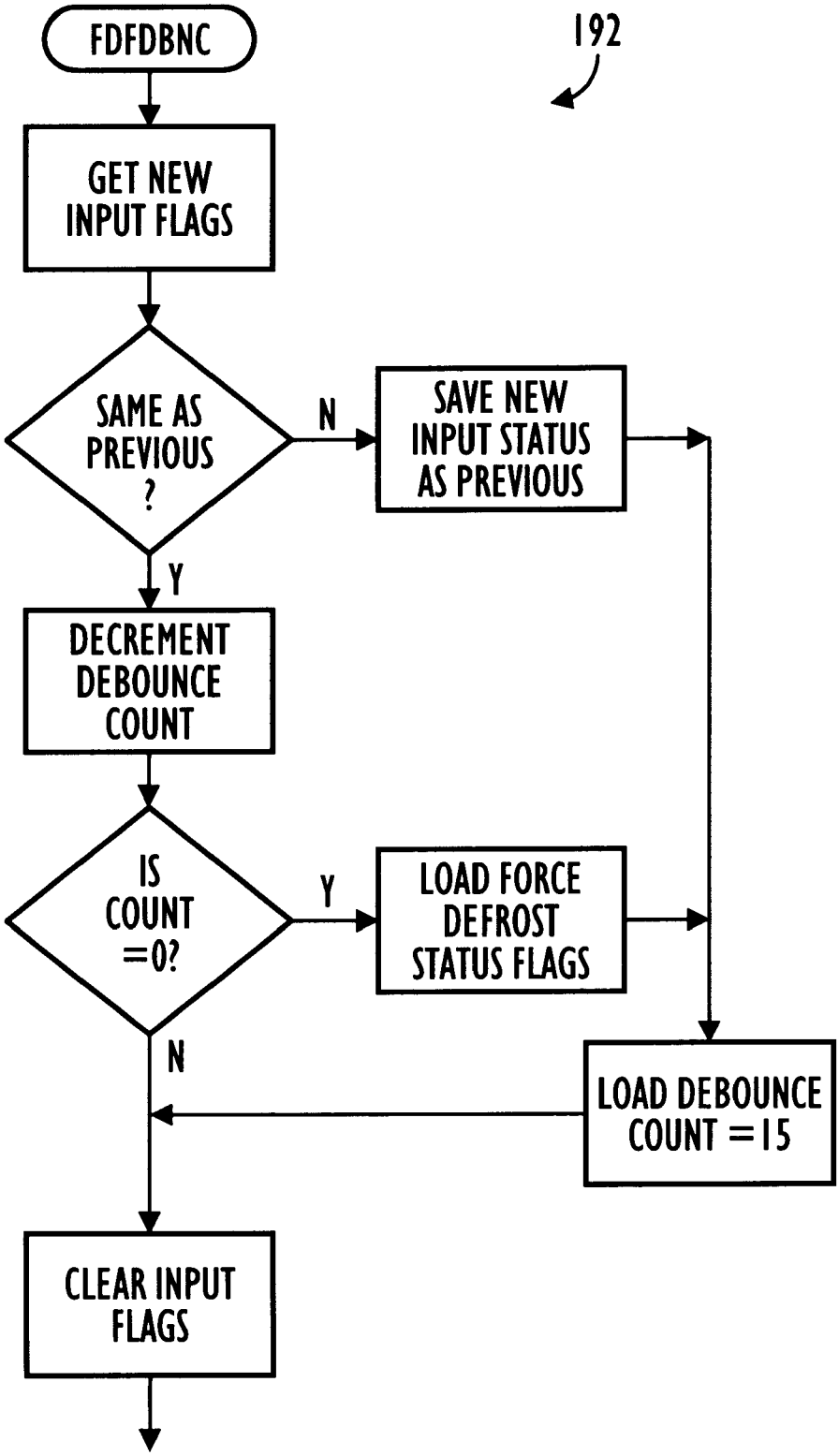
Figure 27:
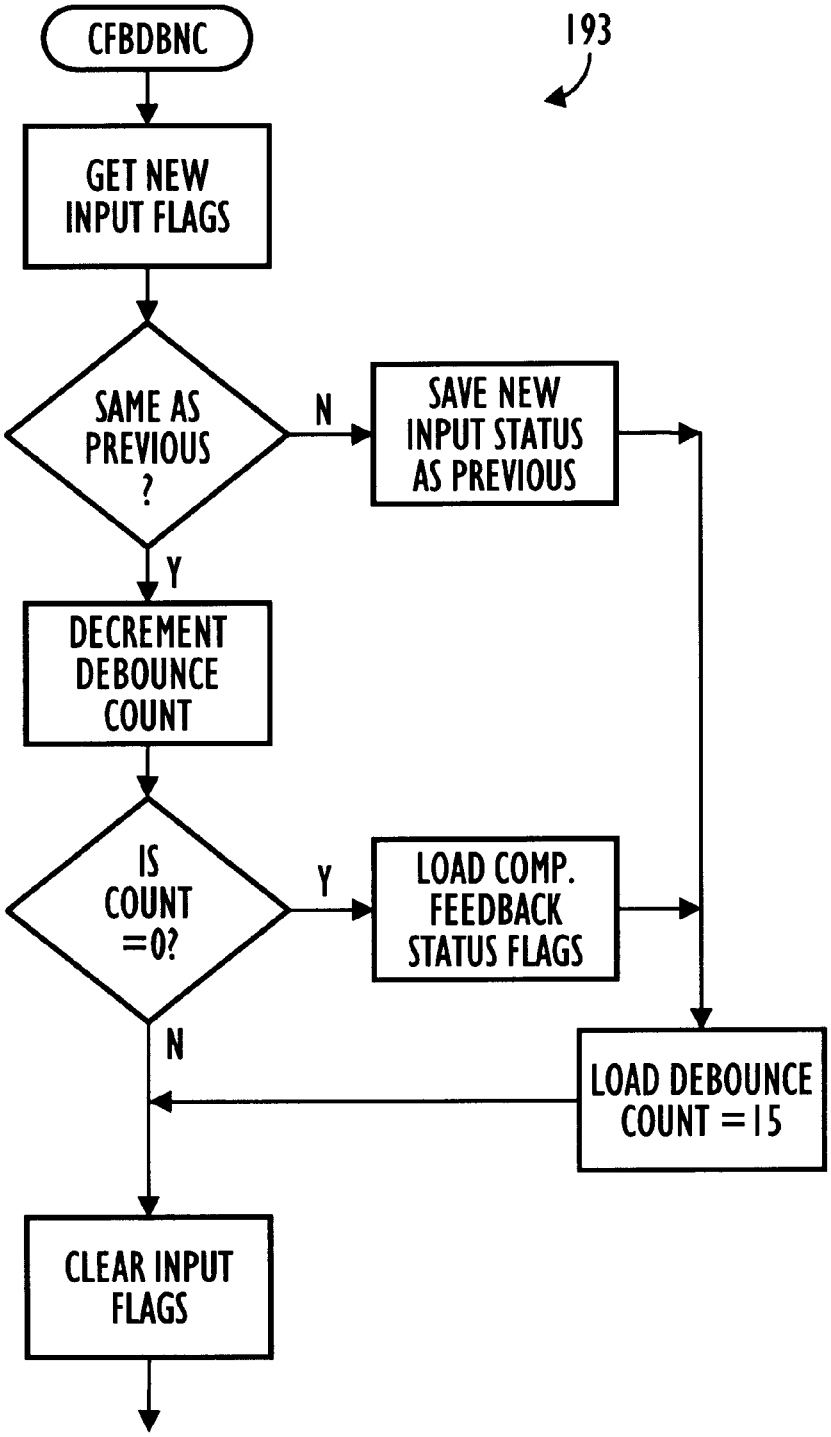

FIGS. 6A, 6B, and 6C illustrate in exploded views of another embodiment of the switch/relay of FIG. 3, configured as an appliance (especially a refrigerator) control module;

FIG. 7 is a simplified schematic diagram of the module of FIGS. 5, 6A, 6B, and 6C including its control circuit;

FIG. 8 is a schematic diagram of the refrigerator control module including circuit details of the control circuit, including its microprocessor or microcontroller; and FIGS. 9 through 28 are flow charts illustrating operation of the microprocessor and its associated program instruction set, wherein:

FIG. 9 is the RESET/MAIN routine flow chart;

FIG. 10 is the RAM CLEAR subroutine flow chart;

FIG. 11 is the PA SERVICE subroutines flow chart;

FIG. 12 is the PB SERVICE subroutines flow chart;

FIG. 13 illustrates the INITIATE REGISTER and CPU REGISTER subroutine flow chart;

FIG. 14 is the TIMERS subroutine flow chart;

FIG. 15 is the DEFROST CONTROL subroutine flow chart;

FIG. 16 is the OUTPUT CONTROL subroutine flow chart;

FIG. 17 is the A/D SERVICE subroutine flow chart;

FIG. 18 is the PULSE TIMER SERVICE subroutine flow chart;

FIG. 19 is the TEMPERATURE CONTROL subroutine flow chart;

FIG. 20 is the COMPRESSOR RUN TIMER subroutine flow chart;

FIG. 21 is the COMPRESSOR DWELL TIMER subroutine flow chart;

FIG. 22 is the DEFROST TIMER SERVICE subroutine flow chart;

FIG. 23 is the TIMER INTERRUPT SERVICE subroutine flow chart;

FIG. 24 is the RELAY OUT subroutine flow chart;

FIG. 25 is the EXTERNAL INTERRUPT subroutine flow chart;

FIG. 26 is the FORCED DEFROST DEBOUNCE subroutine flow chart;

FIG. 27 is the COMPRESSOR FEEDBACK DEBOUNCE subroutine flow chart; and

Figure 28:
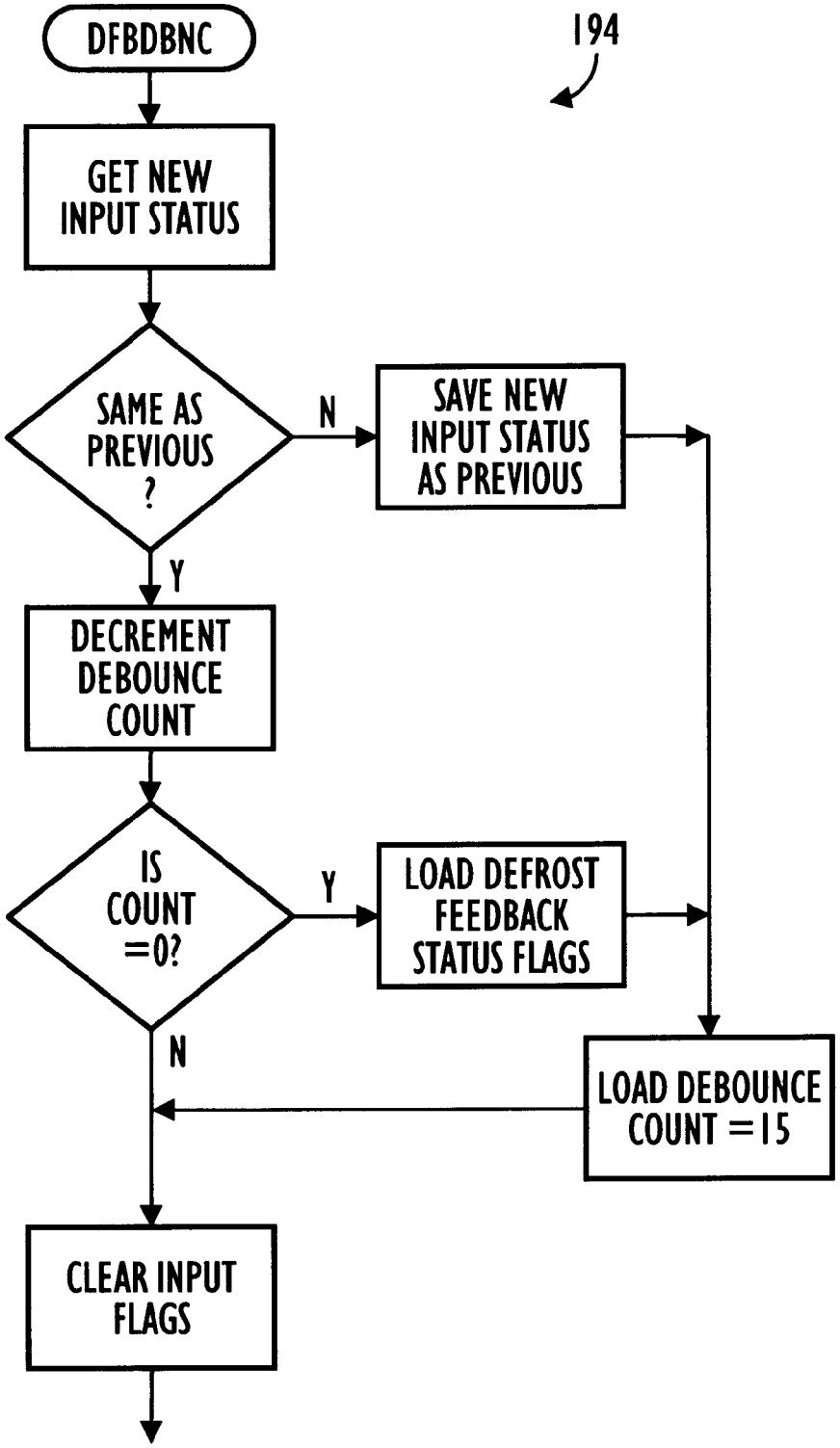

FIG. 28 is the DEFROST FEEDBACK DEBOUNCE subroutine flow chart.

DETAILED DESCRIPTION OF THE PREFERRED EMBODIMENTS

Figure 1:
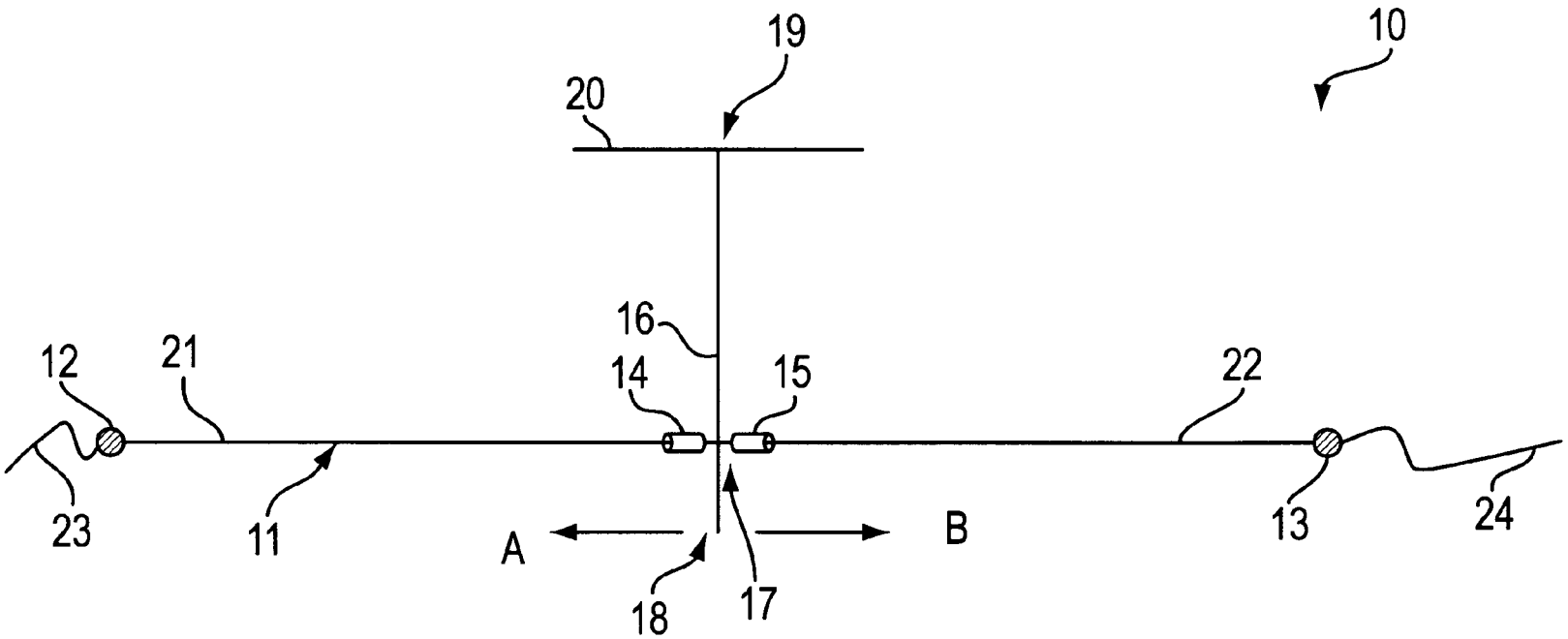
FIG. 1 illustrates a simplified view of the shape memory alloy switch actuator of the present invention.
Figure 2:
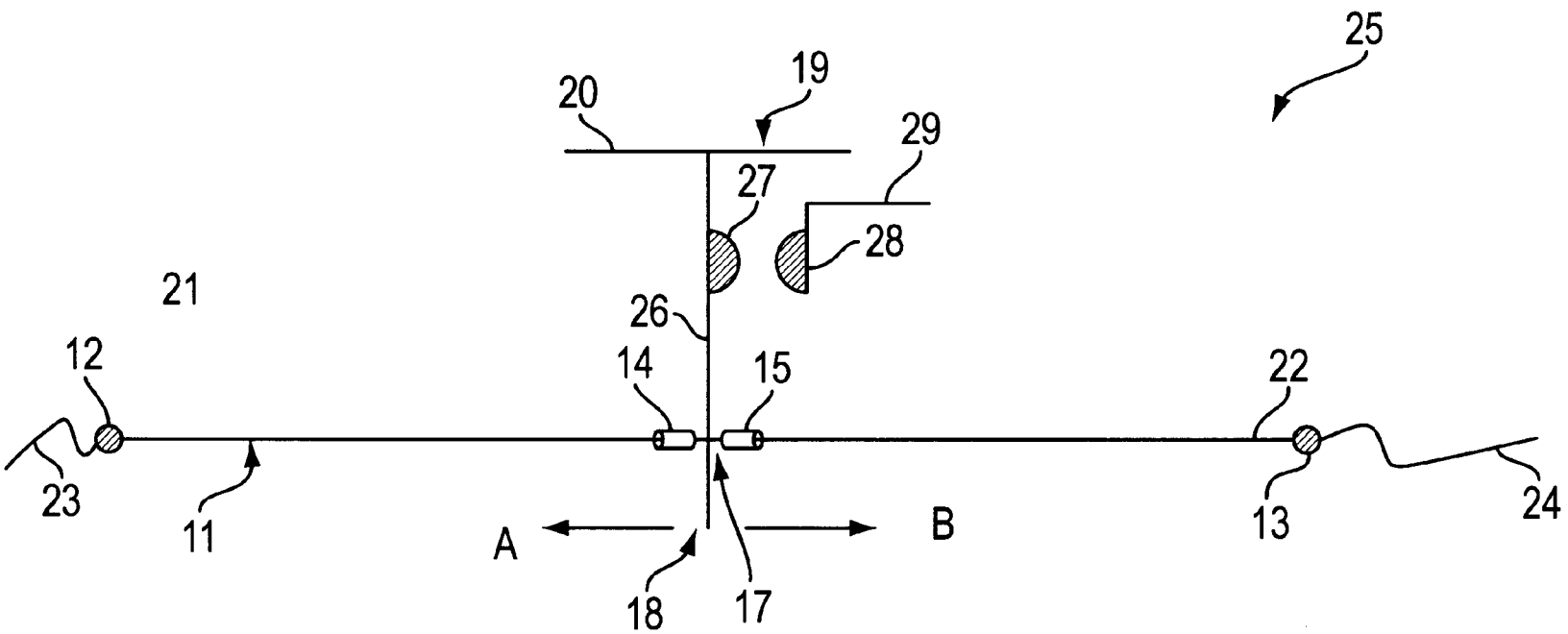
FIG. 2 illustrates a simplified view of the shape memory alloy switch of FIG. 1, operated as a latching relay.

Referring now to FIGS. 1 and 2, there is shown a shape memory alloy switch actuator 10 mechanism underlying the several embodiments of the present invention. A shape memory alloy (SMA) conductor, is shown here in the preferable form of a wire 11 extending between two fixed points 12 and 13. Posts may be used for these two fixed points 12, 13, or other supporting structures as may be desired. A pair or ferrules 14, 15 positions a cantilevered arm 16 along the length of SMA wire 11. A single slotted ferrule adapted to hold the arm 16 may be substituted (not shown).

The ferrules 14, 15 serve two functions; to position the arm 16 as stated, and secondly, to make electrical contact with the SMA wire 11 at a point of contact 17 along the length of the wire 11. Cantilevered arm 16 includes a free end 18 and a fixed end at 19 where it is fixed to a support 20. Thus, the SMA wire 11 is divided into two respective portions 21 and 22 by the point of contact 17.

In one variation of this scheme, separate sections of SMA wire 11 are used for each portion 21, 22. That is, the ferrule pieces 14, 15 are omitted and the respective portions of SMA wire 11 are bonded to the arm 16 at one end and to the respective end point at the other.

Application of an electrical current through an SMA conductor causes the length thereof to decline; this reduction in length can be effected relatively instantaneously. With reference to FIGS. 1 and 2, passing an electrical current through SMA portion 21 by application of current between the point of contact 17 (via cantilevered arm 16) and either point 12 or 13, through conductors 23 or 24, respectively, thus effects a sudden shrinkage of either wire 11 portion 21 or 22, respectively. Current flow in portion 21 causes the arm 16 to move to the left as indicated by arrow "A", while current flow in portion 22 causes the arm 16 to move to the right as indicated by arrow "B". A continuous current flow is normally required to move the point of contact 17 in either direction and maintain it in that position. When switch contacts are added, as between the arm 16 and another adjacent point, this effect provides a switching contact momentary action which is dependent on the duration of the current flow. When current flow is interrupted in this configuration, the SMA wire 11 returns to its original length, subject to some small degree of hysteresis motion.

FIG. 2 illustrates another embodiment of the SMA switch actuator included in a latching relay 25, wherein a bistable snap-action cantilever arm 26 is substituted for cantilever arm 16 of FIG. 1. Such snap-action elements are well known to persons having ordinary skill in the electrical and mechanical switching art. For example, a tensioned element or bimetallic element lever 26 may be used. Similarly, a bimorph element (not shown) may be used in an appropriate instance. The latching relay of FIG. 2 is a simple single-pole, single throw device in this illustrative embodiment. It will be apparent to persons having ordinary skill in the art that once snapped to either of its bistable positions, no further electrical power or other energy is required to maintain the snap-action cantilever arm 26 in either direction "A" or "B".

Electrical switching contacts 27 (movable) and 28 (fixed) provide electrical switching upon operation of the actuator. Contact 28 is supported by a member 29. Note that the spacing indicated for contacts 27, 28 is exaggerated for purposes of illustration; in practice they may lie closer together. In any case, their spacing should be selected such that the contacts close sufficiently to carry the desired current and open sufficiently to ensure breaking of the circuit. Of course, those persons having ordinary skill in the electrical switching art will recognize that the size, shape, material, and disposition of the switch contacts 27,28 will determine the current-carrying capacity thereof.

In the latching switch/relay embodiment shown in FIG. 2, the snap-action cantilevered arm 26 carries contact 27. Contact 27 may be electrically connected to the arm 26 or insulated therefrom, as may be desired. For simplicity of illustration, contact 27 is shown here electrically connected to the arm 26. Thus an electrical circuit extends from contact 27, through arm 26 to the SMA wire 11 point of contact 17, and then through either wire 11 portion 21 or 22 to respective end points 12 or 13.

In operation, application of a current pulse, which may be quite brief, to SMA wire 11 portion 21 causes the arm 26 and thus contact 27 to snap away from contact 28 in direction "A", opening the circuit. Application of a current pulse, which may also be quite brief, to SMA wire 11 portion 22 causes the arm 26 and thus contact 27 to snap towards contact 28 in direction "B", closing the circuit. The contacts remain in the position to which they are directed by application of current to the respective SMA wire 11 portions 21 or 22: open at "A" or closed at "B". It will be apparent that a plurality of contacts may be associated with the arm 26 and/or as fixed contacts (not shown), and that the contacts may be arranged in any of the normal switching configurations (not shown). A plurality of individual sets of contacts may be associated with each of a plurality of wire 11 portions if desired (not shown).

Referring now to FIG. 3, there is shown a simplified schematic of one arrangment forming a latching switch/relay including two sets of single closure contacts. For the purposes of this discussion, it will be assumed that snap-action arm portions are used to provide the latching function. A common anchor point 31 is provided for each of two SMA wire portions extending from point 12 to the respective connections 17 to snap-acting dual cantilever arm 32. The SMA wire 11 portions then continue from the dual cantilever arm 32 to individual respective end points 13, 33, where additional electrical connections can be made thereto.

The arm 32 is fixed at its mid-point anchor position 31, permitting the movable electrical contacts 27 and 34 to move towards their respective fixed contacts 28 and 35. This configuration provides two single throw switching contacts which individually latch in the ON or OFF condition. Application of current between point 12 and a common terminal 36 at mid-point anchor 31 draws the contacts 27 and 34 on both ends of cantilever arm 32 away from their respective contacts 28 and 35. Application of current between common terminal 36 and either of end points 13, 33 closes the respective contacts 27 or 34 with their respective contacts 28 or 35.

Figure 4:
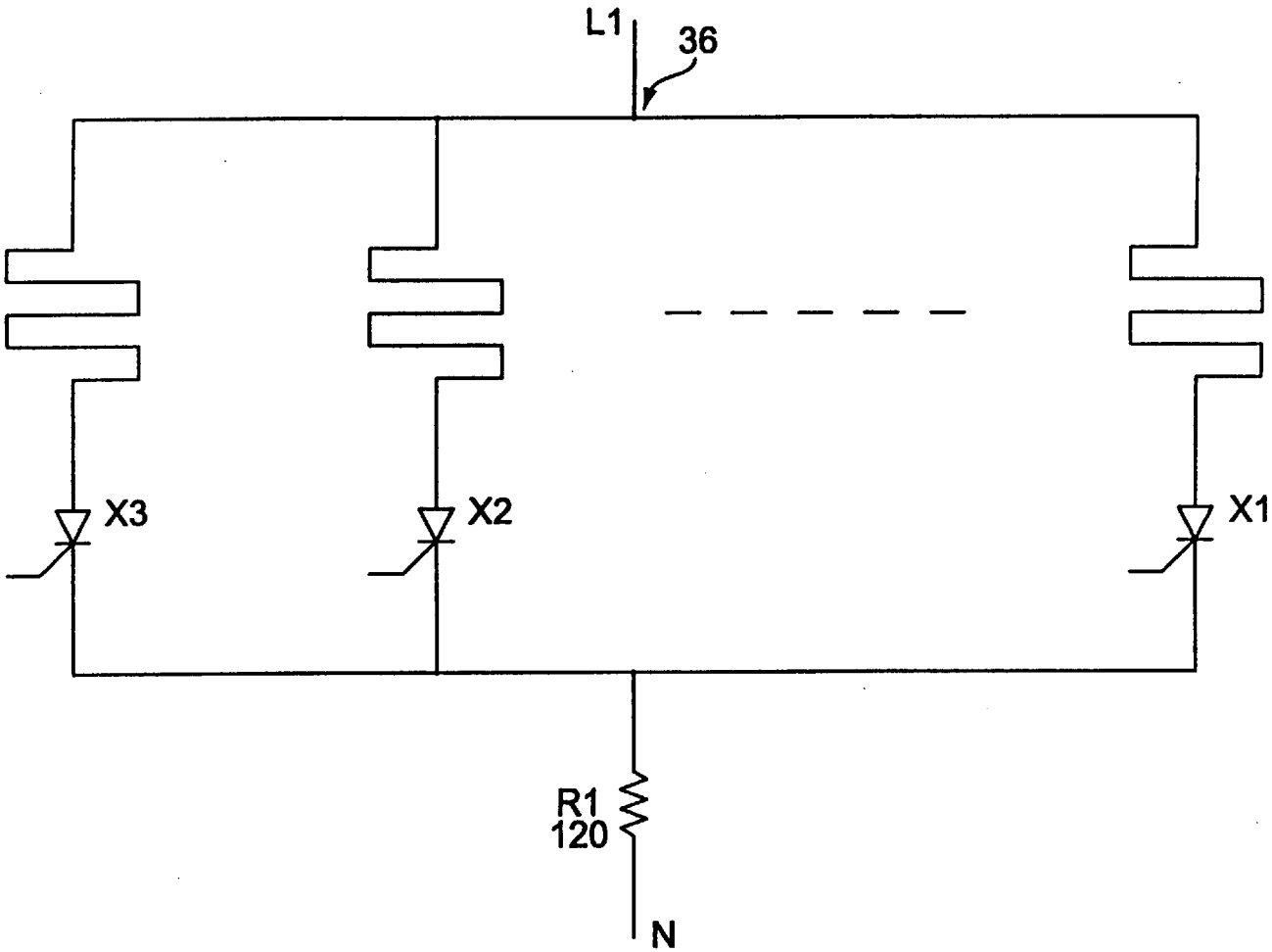
FIG. 4 is a simplified schematic diagram of the SMA switch drive circuit.

FIG. 4 illustrates a sample driving circuit for powering the SMA wire. For simplicity, each of the SMA wire portions is connected to the drive circuit illustrated in FIG. 4 and switched by an SCR X1 through X3 or equivalent. Here, three SMA wires are shown each connected to an SCR anode, and indicating that any reasonable number of switches may be operated together or separately in the same latching switch/relay. The point connection 36 is connected to one side L1 of an AC mains line of, for example, 120 volts. The other operative end portion of a given wire segment is connected through the SCR cathode and a common current limiting series resistor R1 (which may be a positive temperature coefficient resistor) to the other side N of the AC mains power source. Control of the SCR trigger electrode G allows a pulse of current (which is, incidentally, rectified by the SCR) through to activate the desired SMA wire portion.

Figure 5:
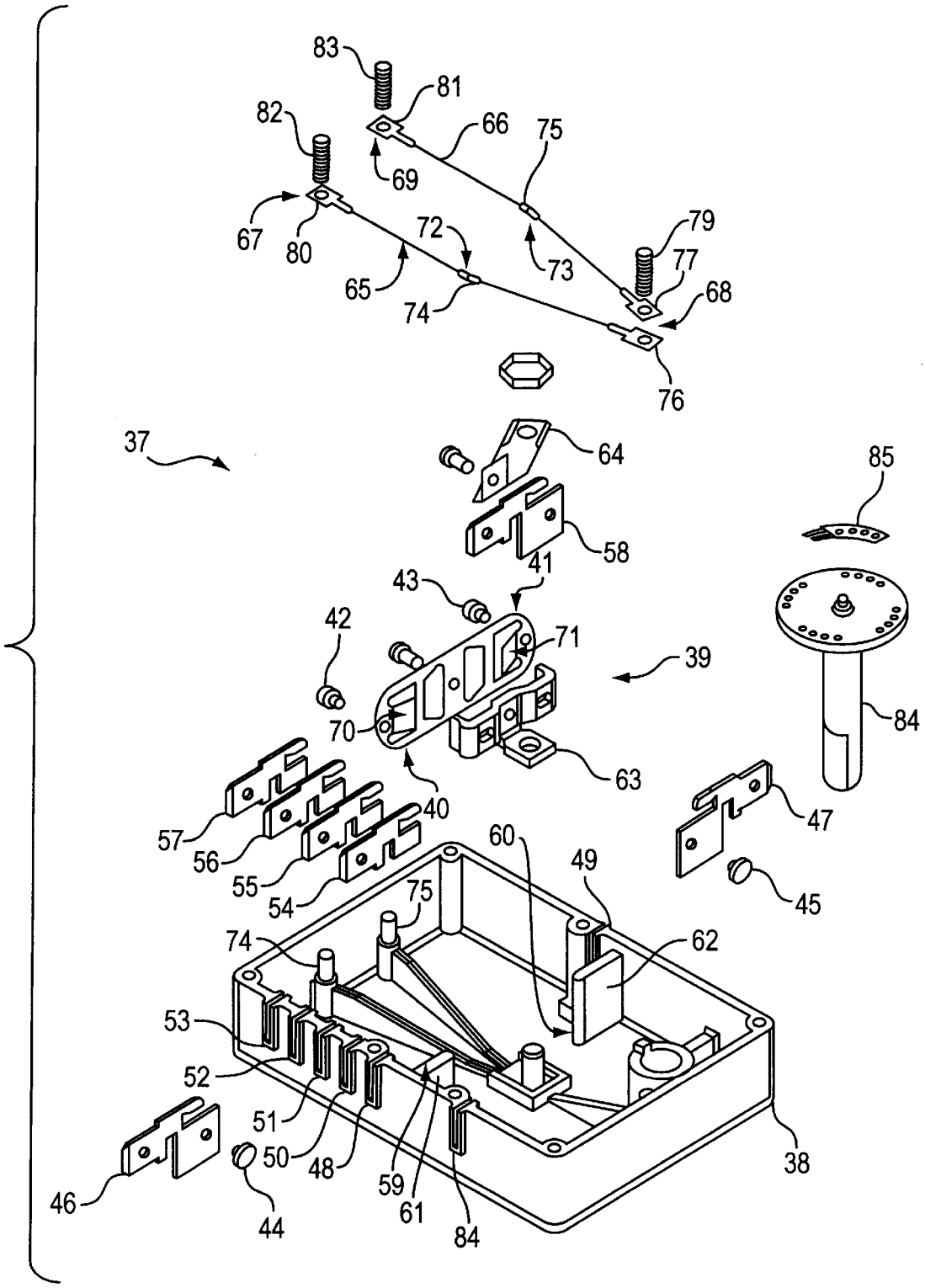
FIG. 5 is an exploded view of one embodiment of the switch/relay of FIG. 3, configured as an appliance (especially a refrigerator) control module.

FIG. 5 shows an embodiment of an appliance control 37 using the SMA latching relay mechanism disclosed herein and specially adapted to use in controlling a refrigerator, in which a pair of SMA wire switches are enclosed in a housing 38. Housing 38 is of resin-filled or like construction, sized to fit into the available refrigerator compartment space. High electrical resistivity and low hygroscopic properties are desirable. A glass-filled polyester, such as Hoechst Celenex 7700 material may be used. Phenolics, such as Dynaset 25378 may also be used. This embodiment includes two switch actuators in housing 38, incorporating as a central element of the housing an electrically conductive, dual-ended snap-action element 39, on each end of which is an arm 40, 41 that is bistable in two positions: an open position and closed position.

The snap-action arm ends thus form cantilevered and movable sides which act independently. Each arm end 40, 41 includes one or more respective electrical contacts 42, 43 which move with the associated snap-action arm end 40, 41 to which it is attached. These moving contacts 42, 43 interface directly with respective stationary contacts 44, 45 when the associated snap-action arm is in one of its two steady-state positions (e.g., ON). Each stationary contact 44, 45 is mounted to a respective terminal 46, 47 electrically insulated from and respectively fixed into housing 38 slots 48, 49. Suitable switch contact materials are known to persons having ordinary skill in the art. Additional slots 50, 51, 52, 53 are provided for terminals 54, 55, 56, 57, respectively, as may be required. Terminals 58, 46, 47, 57, 56, 55, and 54 may be made of brass or other suitable strong, conductive material.

The contact pairs 42, 44 and 43, 45 thus form latching switches which can make direct contact to any device that requires electrical switching of a power circuit. For example, the refrigerator control module would normally control a compressor (not shown) and/or a defrost element (not shown). Since these refrigerator components are powered from AC mains line voltage, AC mains power can be passed to the switch from terminal 58 through the snap action switches to such compressor and/or defroster terminals as 46, 47.

In the OFF position, when the switch(es) lie in the open position, each of the movable contact 42 or 43 rests against an insulated stop surface 59, 60 associated respectively with internal wall portions 61, 62, also forming a part of the housing 38 in this illustrative embodiment. Those persons having ordinary skill in the art will recognize that additional contacts (not shown in this illustration) would be placed at one or both of the OFF position insulated stop surface(s) 59, 60, should double-throw switches be desired or required in a given use.

The dual-ended snap-action element 39 is centrally supported by an electrically conductive support 63. The support 63 is fastened to or formed in the housing 38. An electrically conductive path is established to support 63 by a conductor 64 and a common terminal 58. The common terminal 58 is also mounted to the housing 38 in slot 49 in the present illustrative embodiment. Electrical power is conveniently provided from a source (not shown) to the device 37 through this common terminal 58, when connected to the external power source.

A pair of elongated shape memory alloy (SMA) elements which may be in the preferred form of a pair individual wires 65, 66, each extends between two end points 67, 68 and 69, 68. The SMA wire is a heat-treated nickel-titanium alloy which includes a ferrous component. Such SMA alloy materials are available from Dynalloy Corporation, Irvine, Calif.

Along each of the wires 65, 66 lies a respective free end 70, 71 of snap-action arm 40, 41 in order to form a respective latching switch actuator. The respective arms 40, 41 may be attached and connected to each of the SMA wires 65, 66 at each of the approximate mid-points 72, 73 thereof at slotted (in this illustrative embodiment) ferrules 74, 75.

The fixed end anchoring points of the wires are formed by the housing 38, and are commonly connected at terminals 76, 77 through common spring element 79 at one end 68 in this embodiment. The fixed ends 67, 69 are separately connected at terminals 80, 81 through springs 82, 83. Terminals 76, 77, 80, 81 are crimped brass ferrule eye terminals; other connectors may also be used. The method of fastening the mid-points may include any of the many methods known to those persons having ordinary skill in the art, including simple crimped brass ferrule terminals 74, 75 with notches (or closely coupled paired ferrule terminals) to receive and engage ends 70, 71 as disclosed herein. The crimped brass ferrule connectors are selected to provide excellent mechanical and electrical connection to the SMA wire elements. In an alternative embodiment, the SMA wire elements extending from 67 to 72, 69 to 73, 72 to 68, and 73 to 68 may be individual wires attached at the respective ends and mid-points thereof.

The SMA wire is moved to its phase transition temperature (about 90 degrees Centigrade) by electrical resistance heating thereof. The SMA wire shrinks longitudinally in this condition. Shrinkage of 4 to 5 percent is available through the present mechanism. Here, heating is accomplished by passing a brief electrical pulse through an SMA wire from an end point to a midpoint. The shrinkage (or contraction) is used to force the snap-action arms between their constrained, bistable positions.

As connected in FIG. 5, both of the latching switch actuators are driven in one direction (e.g., open, or OFF) by a common pulse applied to the snap-action element 39 and the common end point 68. The respective switch actuators are driven in the opposite direction (e.g., closed, or ON) by applying separate pulses between the respective ends 67, 69 and the respective midpoints 72, 73 connected to element 39. Thus, each half of an SMA wire contracts in a desired direction by passing a current through a one-half SMA wire portion 65, 66 to change the state of an arm 40 or 41. That is, activation of the SMA wire 65 by applying a current pulse between terminal 80 and mid-point 72 through arm 40 causes the SMA wire portion to shrink and move snap-action arm 40—and thus contact 42—against fixed contact 44 of terminal 46, which seats in housing 38 slot 84. When snapped to its closed state, the switch thus formed passes current through terminal 58 into housing 38 along conductive strip 64, through support 63 and snap-action arm 40 contact 42 to stationary contact 44 affixed to terminal 46. A similar path is traced with the other SMA switch.

Additional components directed to refrigerator control module functions are shown in FIG. 5, including thermostat shaft 84 and thermostat wiper contact 85 (phosphor bronze) to enable temperature control. Where required, the previously identified PTC resistor element (not shown in this simplified view) may be disposed in the housing as well.

A variation on the appliance control module especially adapted for refrigeration use is shown in the exploded views of FIGS. 6A, 6B, and 6C. In control module 87, an open face in housing 88 is covered by a printed circuit board 89 to form an enclosed space for a pair of SMA switching circuits and certain accessory elements. Circuit traces and components, as necessary, may be mounted to the reverse side of PC board 89 and placed over the open face of housing 88 to close and seal the enclosed space formed by the housing 88 and PC board cover 89. The enclosure may, but need not for the present invention, be tightly closed and/or sealed. One or more pins 195 may be included to facilitate location and closure of the PC board. Threaded fasteners may also be used where desired.

Housing 88 is of resin-filled or like unitary construction, size to fit into the available refrigerator compartment space. High strength, high electrical resistivity, and low hygroscopic properties are desirable. A glass-filled polyester, such as Hoechst Celenex 7700 material may be used. Phenolics, such as Dynaset 25378 may also be used. The high strength is preferred as certain morphological features of the housing 88 are adapted to retain components of this embodiment in place under tension, wear, the application of external forces, applied spring forces, or the like.

A plurality of slots and slot-like receptacles extend into the face of the housing 88. These slots are configured to receive mechanical and electrical components and thus must withstand various mechanical and electromechanical forces. In this illustrative embodiment, three of these slots 90, 91, and 92 receive and retain power terminal members, discussed hereinafter. Slots 90, 91, 92 extend axially toward the bottom of housing 88 through sidewalls and are preferably reinforced about their respective longitudinal channels. An additional three (or more) of these slots 93, 94, 95 receive electrical power terminal members which perform multiple functions and thus must withstand additional forces. These slots 93, 94, 95 therefore include larger, axially forward extending reinforced receiving channels through the sidewall extend into the housing 88, and preferably may join with the bottom wall thereof for added strength.

Several reinforced, slot-like receptacles are disposed along respective sidewalls of housing 88. These receptacles are adapted to receive and secure therewithin position-sensitive elements of the present embodiment. More particularly, slot 96 grips SMA connector terminals 97, 98 and a bifurcated contact strip 99 adapted to secure by compression the terminals 97, 98 (and thus the end 100 of the SMA wires) therein. The opposite ends 101, 102 of SMA wires 103, 104 (respectively) lie securely in channels 105, 106, retained therein by contact strips 107, 108, respectively. These contact strips are pressed into the respective channels along with the terminals to the desired position. Contact strips 99, 107, 108 may be dimpled or deviated from planar shape in order to ensure sufficient contact with the terminals.

The contact strips 99, 107, 108 perform multiple functions. First, these strips securely hold the respective captive elements (wire ends 100, 101, 102) in the housing slots. Secondly, these strips make secure and reliable electrical contact with the elements which they hold in place. Additionally, these contact strips and a plurality of the aforementioned power terminals position and hold contact springs (109, 110, 111, 112, 113, 114, 115, 116, 117) that complete electrical connection between the respective contact strip or terminal and appropriately positioned contact land areas (not shown) on the reverse face of the PC board, 89, which covers the housing 88 opening. Terminals 118, 198, and 199 support springs 116, 115, and 114, respectively. These terminals are used for internal connections inside the housing.

Reliable electrical contact between PC board 89 and the various points within housing 88 is accomplished through compression springs positioned therebetween. More particularly, the contact strips (e.g., strip 99) and the power terminals (e.g., terminal 118) include notches 119, 120 to receive and hold the springs, e.g., spring 116, which may as in the illustrative example be helical compression springs. These springs are made of electrically conductive, oxidation resistant material, preferably phosphor bronze, or of plated stainless steel.

A more complex physical arrangement is used to hold the dual-gang snap-action element 121 in its receiving slot 122. Element 121 includes a 90-degree angled lip which mates and fits together with L-shaped reinforcement 123 in reinforced slot 122. Slot 122 is formed in a sidewall of the housing 88. Electrical connection of element 121 to power input terminal 124 is discussed hereinafter.

Two SMA wire actuators cooperate with a dual-gang snap-action element 121 to form dual electrical latching switches or relays. The present invention comprehends addition of extra switch elements and contacts to the unit as may be required in a given situation. These latching switch/relays are formed of SMA wire elements 103, 104 mechanically and electrically connected to, and cooperating with element 121 as generally described above.

More particularly, each of the SMA wires is disposed between two locations: 101, 100 and 102, 100 in a manner similar to that of FIG. 5, previously described. Electrical/mechanical connections can be provided along the length of the SMA wires 103, 104 permitting the element 121 to be joined to the SMA wires 103, 104. Electrical connection to the SMA wires is preferably accomplished, as before, with crimped brass ferrules at the ends of the wires. However, the present ferrules are terminated in planar ends 98, 97, 125, and 126, bent normal to the axis of the SMA wires to enable the contact strips 99, 107, and 108 to grip the wire ends in slots 96, 105, and 106, respectively.

Similar barrel ferrules are centrally located along the length of the wires 103, 104 at points 127, 128 for the purposes of mechanical connection to the snap-action arms 129, 130 and for making electrical contact therewith. In this embodiment, the wires 103, 104 are joined by the notched ferrules 131, 132 to engagement notches 133, 134 formed along the length of arms 129, 130.

Dual-gang snap-action element 121 includes arms 129, 130. The free ends 135, 136 of arms 129, 130 make physical and electrical contact to element 121 through firm physical contact with respective engagement lips 137, 138 of terminal 124. Terminal 124 brings AC mains power into the housing 88. The free ends 135, 136 are deflected by engagement lips 137, 138 to firmly stress the ends 135, 136 against the lips, ensuring good physical and electrical contact and enhancing the snap-action of the arms 129, 130. This stress slightly bends the tongues culminating with ends 135, 136.

Individually, arms 129, 130 are tensioned by the SMA wires 103, 104 by the passage of electrical current through them such that the respective wires heat up, shrink, and snap the arms 129, 130 between their two stable states, Contacts 139, 140 are thus individually firmly urged into intimate contact with electrical contacts 141, 142, respectively. These are in turn mounted on and connected to power terminals 143, 144. Contacts 139, 140, 141, 142 are preferably affixed to the respective arms 129, 130 and terminals 143, 144.

The switch/relay 87 is operated in the following manner according to the embodiment of FIGS. 6A through 6C. As connected in FIG. 6B, both of the latching switch actuators are driven in one direction (e.g., open, or OFF) by a common pulse applied to the wires 103, 104 between their mid-points 127, 128 through the snap-action element 121, thence through terminal 124 and to the common end point 100 via bifurcated contact strip 99. AC mains power can be used with SCR's or the like as previously described to provide motive power.

The respective switch actuators are driven in the opposite direction (e.g., closed, or ON) by applying separate current pulses to the wires 103, 104 between the respective midpoints 127, 128 and ends 101, 102 through contact strips 107, 108. The respective wire portions contract through electrical heating when thus powered and cause the respective snap-action arm to move in the direction of the contraction.

Additional components directed to refrigerator control module functions are shown in FIG. 6B, including thermostat shaft 145 and thermostat wiper contact 146 (phosphor bronze) to enable temperature control. Where required, the previously identified PTC resistor element (not shown in this simplified view) may be disposed in the housing as well.

Adaptive control of appliances, especially refrigerators, is becoming increasingly desirable in order to lower energy costs associated with operation of household appliances, as these energy needs become significant considering the number of appliances connected at any given moment. Examples of advanced control systems are illustrated in U.S. Pat. Nos. 4,251,988, 4,395,887, 4,850,204, 5,295,361, 5,479,785, 5,533,349, and 5,533,350, the teaching of which are hereby incorporated in their entirety.

Adaptive Defrost Control (ADC) of refrigerators is accomplished through control of the defrost cycle using the compressor ON-time, as well as other elements including environmental sensors, to better enhance the efficiencies of the refrigerating system. ADC is normally algorithm based. ADC is used in control of the Refrigerator Control Module (RCM) which forms one embodiment of the present invention. The refrigerator control module is used to control the inside temperature of a refrigerator and/or freezer, including the compressor and defroster subsystems. Another subsystem, known as a Zone Control Module (ZCM) can be used with (and may be part of) the refrigerator control module. It may be used with an RCM to control multiple temperature environments in a refrigerator/freezer combination.

Referring now to FIG. 7, a simplified schematic diagram of an advanced refrigerator control module 147 according to the present invention is illustrated. The advanced refrigerator control module 147 includes a control circuit 148 (shown in more detail in FIG. 8), a latching switch/relay actuator mechanism indicated generally at 149 (in which a positive temperature coefficient resistance element 150 is included in the housing), and the conventional refrigerator elements indicated generally at 151, including a conventional motor 152, and a defrost element 153 which may be protected with a thermal cut-out element 154. The latching switch/relay mechanism 149 may be configured according to FIGS. 5, 6, or any equivalent. An optional fan motor 197, which may be controlled by the control circuit 148, is also shown.

FIG. 8 shows the control circuit 148 in greater detail, with some portions of the main circuit included for ease of understanding. Dotted lines separate the circuit portions for clarity. The CPU 155 (which may be a microprocessor, microcontroller, or equivalent, such as an SGS ST6200) is powered from the AC mains by a conventional power supply 156.

Power comes into the power supply circuit 156 from AC mains via the E1 and E2 terminals 157, 158, respectively. The power supply is in this example an unregulated, current limited design. R1 coarsely limits the current available through D1 during the forward biased period. R2 limits the peak reverse voltage applied to D1. Filtration is provided by C1, while R4 provides fine adjustment of the current limiting and improves AC ripple filtration at VCC. C2 and C3 are conventional noise and ripple reducing components. An AC voltage reference is provided to the CPU/microcontroller 155 via R3, which limits the current therethrough to limit current to the internal over/undervoltage diodes.

The switch actuators, such as the examples shown in FIGS. 5 and 6, are powered by the SCR's under CPU 155 control, as previously discussed in relation with FIG. 4. Relay drive, indicated generally at 159, is accomplished by gating any of the three SCR's. Minimum gate current is only 100 microamps. The associated PTC resistor 150 (FIG. 7) is only required to limit line current to a nominal value, such as about 1 Ampere, passing such a value for about 1.5 seconds at an ambient limit of 30 degrees Centigrade. The PTC resistor 150 is primarily required in case of component failure. The SMA switch actuators (as, for example, shown in FIGS. 5 and 6) are operated by supplying current to the DEFROST RELAY terminal 160, COMPRESSOR RELAY 161, or OFF RELAY terminal 162 from current source 163 when SCR gates 164, 165, or 166, respectively are activated by the respective CPU/microcontroller 155 outputs.

Temperature control section 167 includes two CPU/microcontroller ports in the present illustrative embodiment. These ports are used to convert an analog voltage created by the voltage divider to digital values. The two settings include a temperature setting control and an ambient temperature sensing function, performed by an NTC thermistor (R8). Temperature settings are provided by thermostat dial potentiometer control 168. The temperature sensor function is provided by thermistor 169.

Two switch/relay status inputs at 170 to CPU 155 represent, respectively, the defroster status and the compressor status. A bimetal switch, or equivalent circuit element is used on the line side of the defrost circuit (thermal cut-out 154 in FIG. 7). A voltage is created when the bimetal switch opens; the lead from the neutral side of the bimetal switch is connected to the defrost detect (DEF_DET) pin to generate the defrost detect signal. The compressor status is similarly detected from the switched side of the compressor (COMP_DET).

Options illustrated include manual defrost and/or fast freeze overrides 196 (only one being shown for simplicity) and an optional fan delay circuit 171. Additional CPU/microcontroller 155 inputs include RESET 172, OSCILLATOR IN 173, and OSCILLATOR OUT 174. These circuits function in their conventional, known manner.

The CPU/microcontroller 155 is operated under control of a program instruction set, illustrated generally in FIGS. 9 through 28, briefly described below in one illustrative embodiment among the many possible operating program instruction sets by which it is possible to program CPU/microcontroller 155. Additional in-circuit programming of the CPU/microcontroller 155 is available through test points at the pins labeled OSCout, OSCin, RESET, TEST/VPP, THERM, COMP_DET, and DEF_DET.

FIG. 9 illustrates the RESET/MAIN routines 176 flow chart. The RESET routine clears RAM and initializes the CPU/microcontroller ports and registers upon change to power—ON. The MAIN routine calls key routines in sequence during normal operation.

FIG. 10 is the RAM CLEAR subroutine flow chart. The RAM CLEAR routine 177 clears all RAM locations at reset.

FIG. 11 is the PA SERVICE subroutine flow chart. The PORT A SERVICE routine 178 sends and receives data from PORT A and sets up the port A configuration registers.

FIG. 12 is the PB SERVICE subroutine flow chart. The PORT B SERVICE routine 179 sends and receives data from PORT B and sets up the port B configuration registers.

FIG. 13 illustrates the INITIATE REGISTER 180 and CPU REGISTER 181 subroutine flow chart. These routines are used to set up the CPU/microcontroller 155 configuration registers at reset and periodically during operation. These registers set up the internal timer parameters and the A/D converter function.

FIG. 14 illustrates the TIMERS subroutine 182, which runs whenever a line cycle edge is detected by the EXTERNAL INTERRUPT routine 183. The A/D converter and pulse timer are serviced every line cycle. The TEMPERATURE CONTROL routine 183 is serviced every 60 line cycles or once per second. The COMPRESSOR RUN TIMER, COMPRESSOR DWELL TIMER and DEFROST TIMER SERVICE routines 185, 186, 187 are serviced once per minute.

FIG. 15 is the DEFROST CONTROL subroutine 188 flow chart. If the defrost request flag is on, this routine will turn on the defrost flag. When the defrost process is complete, the defrost flag will be turned off and a new frost time will be calculated based on the duration of the defrost process.

FIG. 16 is the OUTPUT CONTROL subroutine 189 flow chart. This routine controls two flags used to control the SMA relay/switch. It does not directly drive the SMA relay/switch; the two flags are used by another relay control routine. The status of the two flags is determined by the compressor and the defrost feedback inputs, the compressor ON flag, and the defrost flag.

FIG. 17 is the A/D SERVICE subroutine 190 flow chart. This routine handles the A/D conversions for the thermistor probe sensor 169 and temperature dial set point 168 inputs. The routine alternately converts the probe and set point inputs and updates the temperatures every half second.

FIG. 18 is the PULSE TIMER SERVICE subroutine 191 flow chart. This timer is used to control the pulse width for the relay drive.

FIG. 19 is the TEMPERATURE CONTROL subroutine 184 flow chart. The thermistor probe sensed temperature and temperature set point are compared once per second and the results are debounced. After the DEBOUNCE time has elapsed, the "call for cool" flag is turned on or off.

FIG. 20 is the COMPRESSOR RUN TIMER subroutine 185 flow chart. When the compressor is on, this timer is decremented once per minute. When this timer is equal to zero, a defrost is initiated.

FIG. 21 is the COMPRESSOR DWELL TIMER subroutine 186 flow chart.

If the defrost flag is on, this timer will decrement. If the timer is equal to zero, the compressor will be allowed to run. This timer is enabled after a defrost terminates.

FIG. 22 is the DEFROST TIMER SERVICE subroutine 187 flow chart. This routine will interrupt the main loop once per millisecond. This allows more accurate control of time sensitive functions. This routine is used to control the switch/relay drives via the RELAY OUT (Rlyout) routine 188 and it also samples the feedback inputs and forced defrost input.

FIG. 23 is the TIMER INTERRUPT SERVICE subroutine 189 flow chart. This routine will interrupt the main loop 176 once per millisecond. This allows more accurate control of time sensitive functions. This routine is used to control the relay/switch drives via the RELAY OUT (Rlyout) routine 188 and it also samples the feedback inputs and forced defrost input.

FIG. 24 is the RELAY OUT subroutine 188 flow chart. This routine directly controls the SMA relay/switch. It will phase fire the SMA relay/switch based on the AC MAINS line VOLTAGE zero crossing and the TIMER INTERRUPT (189) count.

FIG. 25 is the EXTERNAL INTERRUPT subroutine 183 flow chart. This routine is driven by the AC mains line voltage reference to the CPU/microcontroller 155. This routine will interrupt the main loop or the TIMER INTERRUPT (189) once per line cycle. This interrupt will allow the control to keep timing accurate to the accuracy of the AC mains line frequency. The EXTERNAL INTERRUPT (183) is also used to DEBOUNCE the feedback inputs and forced defrost inputs. The TIMER INTERRUPT (189) is synchronized to this interrupt.

FIG. 26 is the FORCED FROST DEBOUNCE subroutine 192 flow chart. This is part of the EXTERNAL INTERRUPT routine 183. The input flags set by the TIMER INTERRUPT routine 189 are tested here. If the input status is stable for 15 line cycles, the input is debounced and considered valid.

FIG. 27 is the COMPRESSOR FEEDBACK DEBOUNCE subroutine 193 flow chart. This is part of the EXTERNAL INTERRUPT routine 183. The input flags set by the TIMER INTERRUPT routine 189 are tested here. If the input status is stable for 15 line cycles, the input is debounced and considered valid.

FIG. 28 is the DEFROST FEEDBACK DEBOUNCE subroutine 194 flow chart. This is part of the EXTERNAL INTERRUPT routine 183. The input flags set by the TIMER INTERRUPT routine 189 are tested here. If the input status is stable for 15 line cycles, the input is debounced and is considered valid.

Although only preferred embodiments of the present invention are specifically illustrated and described herein, it will be appreciated that many modifications and variations of this present invention are possible in light of the above teachings and within the purview of the appended claims without departing from the spirit and intended scope of the invention.

We claim:

1. An electrical switch, comprising:

a single-piece elongated shape memory alloy actuator having a first portion and a second portion;

a switching arm, coupled to the first and second actuator portions, the switching arm having first and second positions;

a first electrical contact;

a second electrical contact connected to the switching arm, and disposed to be electrically isolated from the first electrical contact when said switching arm is in the first position and disposed to be electrically connected to the first electrical contact when said switching arm is in the second position;

a first electrical path for applying an electrical current through the first portion of the actuator; and a second electrical path for applying an electrical current through the second portion of the actuator.

2. The switch of claim 1, wherein the switching arm includes:

a fixed point; and a movable portion for moving about the fixed point, said second electrical contact disposed on the movable portion.

3. The switch of claim 2, wherein said first electrical path includes the first actuator portion and at least a portion of the switching arm.

4. The switch of claim 2, wherein said second electrical path includes the second actuator portion and at least a portion of the switching arm.

5. The switch of claim 1, further comprising:

a first control switch for passing an electric current through said first electrical path; and a second control switch for passing an electric current through said second electrical path.

6. The switch of claim 5, wherein each of the first and second control switches includes an SCR.

7. The switch of claim 1, wherein the actuator includes a wire with a diameter of about 0.006 inches.

8. The switch of claim 1, wherein the actuator includes a wire with an electrical resistance of about 1.2 ohms per inch.

9. The switch of claim 1, wherein at least one of the first and second portions of the actuator have a first length when an internal temperature of such portion is less than a threshold temperature and a second length when the internal temperature is greater than the threshold temperature.

10. The switch of claim 9, wherein the second length is shorter than the first length.

11. The switch of claim 10, wherein the second length is shorter than the first length by an amount of about 4 percent.

12. The switch of claim 10, wherein:

the switching arm is in the first position when the length of the second actuator portion is the second length; and the switching arm is in the second position when the length of the first actuator portion is the second length.

13. The switch of claim 1, wherein the switching arm is electrically and mechanically coupled to the first and second actuator portions.

14. The switch of claim 13, wherein the switching arm is bonded to at least one of the first and second actuator portions.

15. The switch of claim 13, wherein the actuator includes a ferrule connected to the first and second actuator portions and disposed in physical contact with the switching arm.

16. The switch of claim 1, wherein the first position is a latching position.

17. The switch of claim 1, wherein the second position is a latching position.

18. A method of switching an electrical load current, comprising:

providing a single-piece elongated shape memory alloy actuator having a first portion and a second portion;

providing a switching arm coupled to the first and second actuator portions;

applying an electric control current through one of the first and second parts;

decreasing the length of said one of the first and second portions when said electric control current passes therethrough;

moving the switching arm from one of the first and second positions to the other of the first and second positions;

electrically isolating a first electrical load contact from a second electrical load contact when the switching arm is in a first position; and electrically connecting the first electrical load contact to the second electrical load contact when the switching arm is in a second position.

19. The method of claim 18, wherein the step of applying an electric control current includes the step of passing the electric control current through the first actuator portion.

20. The method of claim 19, wherein the step of moving includes the step of moving the switching arm from the first position to the second position when the length of the first actuator portion is decreased.

21. The method of claim 20, wherein the step of moving further includes the step of latching the switching arm in the second position.

22. The method of claim 18, wherein the step of applying an electric control current includes the step of passing the electric control current through the second actuator portion.

23. The method of claim 22, wherein the step of moving includes the step of moving the switching arm from the second position to the first position when the length of the second actuator portion is decreased.

24. The method of claim 23, wherein the step of moving further includes the step of latching the switching arm in the first position.

25. The method of claim 18, wherein the step of applying an electric control current includes the step of increasing a temperature of one of the first and second portions of said actuator through current-induced heating.

26. The method of claim 25, wherein the step of increasing a temperature includes the step of increasing the temperature above a threshold temperature.

27. The method of claim 26, wherein the step of moving includes the step of decreasing a length of one of the first and second portions of the actuator by the step of increasing the temperature above the threshold temperature.

28. Switching control module comprising:

a single-piece elongated shape memory alloy actuator having a first portion and a second portion:

a switching arm, coupled to the first and second actuator portions, the arm having first and second positions;

a first electrical contact;

a second electrical contact connected to the switching arm, and disposed to be electrically isolated from the first electrical contact when said arm is in the first position and disposed to be electrically connected to the first electrical contact when said arm is in the second position:

a first electrical path for applying an electrical current through the first portion of the actuator;

a second electrical path for applying an electrical current through the second portion of the actuator;

a housing;

a control device for effecting movement of the switching arm from the first position to the second position and from the second position to the first position;

a first control switch for passing an electric current through said first electrical path; and a second control switch for passing an electric current through said second electrical path; wherein each of the first and second control switches includes an SCR.

29. The control module of claim 28, wherein the actuator includes a wire with a diameter of about 0.006 inches.

30. The control module of claim 28, wherein the actuator includes a wire with an electrical resistance of about 1.2 ohms per inch.

31. The control module of claim 28, wherein at least one of the first and second portions of the actuator have a first length when an internal temperature of such portion is less than a given threshold temperature and a second length that is shorter than the first length by an amount of about 4 percent when the internal temperature is greater than the given threshold temperature.

32. An adaptive switching control module comprising:

a single-piece elongated shape memory alloy actuator having a first portion and a second portion;

a switching arm, coupled to the first and second actuator portions, the arm having first and second positions;

a first electrical contact;

a second electrical contact connected to the switching arm, and disposed to be electrically isolated from the first electrical contact when said arm is in the first position and disposed to be electrically connected to the first electrical contact when said arm is in the second position;

a first electrical path for applying an electrical current through the first actuator portion;

a second electrical path for applying an electrical current through the second actuator portion;

a housing;

an adaptive control device for effecting movement of the switching arm from the first position to the second position and from the second position to the first position;

a first control switch for passing an electric current through said first electrical path; and a second control switch for passing an electric current through said second electrical path;

wherein each of the first and second control switches includes an SCR.

33. An adaptive switching control module comprising:

a single-piece elongated shape memory alloy actuator having a first portion and a second portion and including a wire with a diameter of about 0.006 inches;

a switching arm, coupled to the first and second actuator portions, the arm having first and second positions;

a first electrical contact;

a second electrical contact connected to the switching arm, and disposed to be electrically isolated from the first electrical contact when said arm is in the first position and disposed to be electrically connected to the first electrical contact when said arm is in the second position;

a first electrical path for applying an electrical current through the first actuator portion;

a second electrical path for applying an electrical current through the second actuator portion;

a housing;

an adaptive control device for effecting movement of the switching arm from the first position to the second position and from the second position to the first position;

a first control switch for passing an electric current through said first electrical path; and a second control switch for passing an electric current through said second electrical path.

34. An adaptive switching control module comprising:

a single-piece elongated shape memory alloy actuator having a first portion and a second portion and including a wire with an electrical resistance of about 1.2 ohms per inch;

a switching arm, coupled to the first and second actuator portions, the arm having first and second positions;

a first electrical contact;

a second electrical contact connected to the switching arm, and disposed to be electrically isolated from the first electrical contact when said arm is in the first position and disposed to be electrically connected to the first electrical contact when said arm is in the second position;

a first electrical path for applying an electrical current through the first actuator portion;

a second electrical path for applying an electrical current through the second actuator portion;

a housing;

an adaptive control device for effecting movement of the switching arm from the first position to the second position and from the second position to the first position;

a first control switch for passing an electric current through said first electrical path; and a second control switch for passing an electric current through said second electrical path.

35. An adaptive switching control module comprising:

a single-piece elongated shape memory alloy actuator having a first portion and a second portion including a wire with an electrical resistance of about 1.2 ohms per inch;

a switching arm, coupled to the first and second actuator portions, the arm having first and second positions;

a first electrical contact;

a second electrical contact connected to the switching arm, and disposed to be electrically isolated from the first electrical contact when said arm is in the first position and disposed to be electrically connected to the first electrical contact when said arm is in the second position;

a first electrical path for applying an electrical current through the first actuator portion;

a second electrical path for applying an electrical current through the second actuator portion;

a housing;

an adaptive control device for effecting movement of the switching arm from the first position to the second position and from the second position to the first position;

a first control switch for passing an electric current through said first electrical path; and a second control switch for passing an electric current through said second electrical path;

wherein at least one of the first and second portions of the actuator have a first length when an internal temperature of such portion is less than a given threshold temperature and a second length that is shorter than the first length by an amount of about 4 percent when the internal temperature is greater than the given threshold temperature.

* * * * *